US009437106B2

(12) United States Patent
Lazarro et al.

(10) Patent No.: US 9,437,106 B2
(45) Date of Patent: Sep. 6, 2016

(54) TECHNIQUES FOR CONTROLLING APPLIANCES

(71) Applicant: Logitech Europe S.A., Lausanne (CH)

(72) Inventors: Adrien Lazarro, Fremont, CA (US); Devon Wang, Newark, CA (US); Richard Titmuss, Newark, CA (US); Jack Ha, Newark, CA (US); Ian Crowe, Burlington (CA); Ranjit Sidhu, Newark, CA (US)

( * ) Notice: Subject to any disclaimer, the term of this patent is extended or adjusted under 35 U.S.C. 154(b) by 300 days.

(21) Appl. No.: 14/043,248

(22) Filed: Oct. 1, 2013

(65) Prior Publication Data

US 2014/0091912 A1 Apr. 3, 2014

Related U.S. Application Data

(60) Provisional application No. 61/708,567, filed on Oct. 1, 2012.

(51) Int. Cl.

| | |
|---|---|
| ***G08C 19/16*** | (2006.01) |
| ***G08C 19/00*** | (2006.01) |
| ***G08C 17/02*** | (2006.01) |
| ***G08C 23/04*** | (2006.01) |

(52) U.S. Cl.

CPC ..... *G08C 19/00* (2013.01); *G08C 17/02* (2013.01); *G08C 23/04* (2013.01); *G08C 2201/32* (2013.01)

(58) Field of Classification Search

CPC .. G08C 19/00; G08C 17/02; G08C 2201/32; G08C 23/04; H04L 12/2823; H04L 2012/2841; H04L 2012/285

See application file for complete search history.

(56) References Cited

U.S. PATENT DOCUMENTS

| | | | | |
|---|---|---|---|---|
| 2003/0234737 | A1* | 12/2003 | Nelson | G08C 19/28 341/176 |
| 2004/0266419 | A1* | 12/2004 | Arling | G08C 17/00 455/420 |
| 2005/0159823 | A1* | 7/2005 | Hayes | G05B 15/02 700/19 |
| 2008/0098426 | A1* | 4/2008 | Candelore | H04N 5/4403 725/38 |
| 2013/0110302 | A1* | 5/2013 | Ferlitsch | H04L 12/2823 700/295 |

* cited by examiner

*Primary Examiner* — Kerri McNally
*Assistant Examiner* — Renee Dorsey
(74) *Attorney, Agent, or Firm* — Kilpatrick Townsend & Stockton LLP

(57) ABSTRACT

Remote control systems utilize touch-sensitive user-input devices and/or displays which may be integral with the touch-sensitive user-input devices. Gestures input into a touch-sensitive user-input device result in signals transmitted to one or more appliances for the purpose of controlling the one or more appliances. A display provides intuitive visual feedback regarding input into the remote control system, through a touch-sensitive user-input device and/or other user-input devices. The remote control systems may be configured and dynamically updated based on user activity in connection with the remote control systems.

28 Claims, 11 Drawing Sheets

TECHNIQUES FOR CONTROLLING APPLIANCES

RELATED APPLICATIONS

This application claims priority to U.S. Provisional Application No. 61/708,567, filed Oct. 1, 2012, the content of which is hereby incorporated by reference in its entirety.

BACKGROUND OF THE INVENTION

Remote control devices have enhanced users' ability to interact with their appliances for many years. Typical remote control devices are utilized to operate various external electronic devices including, but not limited to, televisions, stereos, receivers, VCRs, DVD players, CD players, amplifiers, equalizers, tape players, cable units, lighting, window shades, and other electronic devices. A conventional remote control is typically comprised of a housing structure, a keypad within the housing structure for entering commands by the user, electronic circuitry within the housing structure connected to the keypad, and a transmitter electrically connected to the electronic circuitry for transmitting a control signal to an electronic device to be operated.

In many remote controls, the user depresses one or more buttons upon the keypad when an operation of a specific electronic device is desired. For example, if the user desires to turn the power off to a VCR, the user will depress the power button upon the remote control which transmits a "power off" control signal that is detected by the VCR, resulting in the VCR turning off.

Because of the multiple electronic devices currently available within many homes and businesses today, some remote controls allow for the control of a plurality of electronic devices commonly referred to as a "universal remote control." Many universal remote controls have "selector buttons" that are associated with the specific electronic device to be controlled by the remote control (e.g., television, VCR; DVD player, etc.). Universal remote control devices allow for the control of a plurality of external electronic devices with a single remote control, thereby eliminating the need to have a plurality of remote controls physically present within a room.

While conventional remote controls work well for many purposes, typical utilization of remote controls is not ideal. For example, many universal remote controls have a large number of buttons, many of which may never be used, since the manufacturers attempt to have physical buttons for many, if not all, possible command of each possible electronic device. Additionally, even when large numbers of buttons are included in the remote, the programming and compatibility of the remote with new devices are often limited. The result is often a device that is cumbersome and not intuitive. Also, electronic components within these devices can be relatively complex and expensive to manufacture, resulting in an increased cost to the consumer.

In addition, remote controls often control appliances using infrared (IR), radio frequency (RF), and/or other types of signals that are invisible to the human eye. As a result, it is often difficult for a user to tell whether a remote control is transmitting a signal at any given time. While some remote controls include features to alert users when a signal is being transmitted, such as flashing light emitting diodes and/or icons, such features are typically primitive, providing a user only rudimentary knowledge of what his/her remote control is doing.

While conventional remote controls may be suitable for the particular purpose to which they are addressed, from the perspectives of cost, ease of use, and expandability, they are not optimal. Accordingly, there exist ongoing needs to provide remote control systems that can be applied to one or more devices in a more intuitive and expandable manner.

SUMMARY

The present subject matter is directed to, among other objects, systems and methods for updating a controller and controlling associated appliances based on dynamically updated state information. According to first aspects of the invention, methods may include one or more steps of detecting the start of an activity and tracking the state of one or more appliances involved in the activity. Embodiments may include detecting an end of the activity and analyzing state data for the one or more appliances obtained, at least partially, during the activity, e.g. between the start and the end of the activity. Embodiments may include generating and/or updating an end-state data for the one or more appliances based on the analysis of the state data. Embodiments may include detecting another starting of the activity, and modifying a state of the one or more appliances based on the detection of the starting of the activity and the end-state data.

In embodiments, modifying the state of the one or more appliances based on the end-state data may include sending a signal from the control device to the one or more appliances to change the state of the one or more appliances to a state corresponding to the end-state data.

In embodiments, the activity may correspond to a preprogrammed macro including instructions for a plurality of appliances.

In embodiments, detecting the start of an activity may include detecting a user input corresponding to selection of the activity.

In embodiments, detecting the start of an activity may include detecting selection of a content source.

Embodiments may include receiving a user command to start the activity. In embodiments, receiving the user command to start the activity may cause a macro to be executed that causes the one or more appliances to update their state to a state corresponding to the end-state data.

In embodiments, at least one of detecting the starting of the activity, and detecting the ending of the activity, may be based on commands entered to the control device.

In embodiments, tracking the state of the one or more appliances involved in the activity may be based on at least a use of the control device.

In embodiments, detecting the first ending of the activity may be based on a power off command that is input to the control device, and/or the end-state data may be based on a state of the one or more appliances prior to the control device sending the power off command.

Embodiments may include querying a user of the control device whether to update the end-state data.

In embodiments, the querying of the user on whether to update the end-state data may be presented based on the control device detecting the ending of the activity.

In embodiments, detecting the end of the activity may be based on a predetermined period of time associated with the activity.

Embodiments may include one or more of detecting another ending of the activity (e.g. a second iteration of the activity), and analyzing state data for the one or more appliances obtained at least partially during the second iteration of the activity.

Embodiments may include updating the end-state data for the one or more appliances based on the analysis of the state data obtained at least partially during the second iteration of the activity.

Embodiments may include detecting a third starting of the activity, and modifying the state of the one or more appliances based on the detection of the third starting of the activity and updated end-state data.

Embodiments may include generating a macro based on one or more of the activity, a selected media content source corresponding to the activity, the end-state data, and/or current state data of the one or more appliances.

Embodiments may include obtaining a device inventory for a user of the control device, obtaining a user interface design parameter for the user, and/or generating a user interface for the control device based on the device inventory and the design parameter.

Embodiments may include one or more of receiving a user selection indicating a content source, obtaining macro data based on the content source, and/or generating a macro based on the obtained macro data.

According to further aspects of the invention, controllers (e.g. remote controls, smartphonesg, tablet computers and the like) may be configured to perform automated processes such as those mentioned above, and described further herein. Embodiments may also include non-transitory computer-readable storage medium including computer-executable instructions for configuring one or more processors to perform such automated processes.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention claimed. The detailed description and the specific examples, however, indicate only preferred embodiments of the invention. Various changes and modifications within the spirit and scope of the invention will become apparent to those skilled in the art from this detailed description.

BRIEF DESCRIPTION OF THE DRAWINGS

Various embodiments in accordance with the present disclosure will be described with reference to the drawings, in which.

DETAILED DESCRIPTION OF THE INVENTION

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Figure 1:
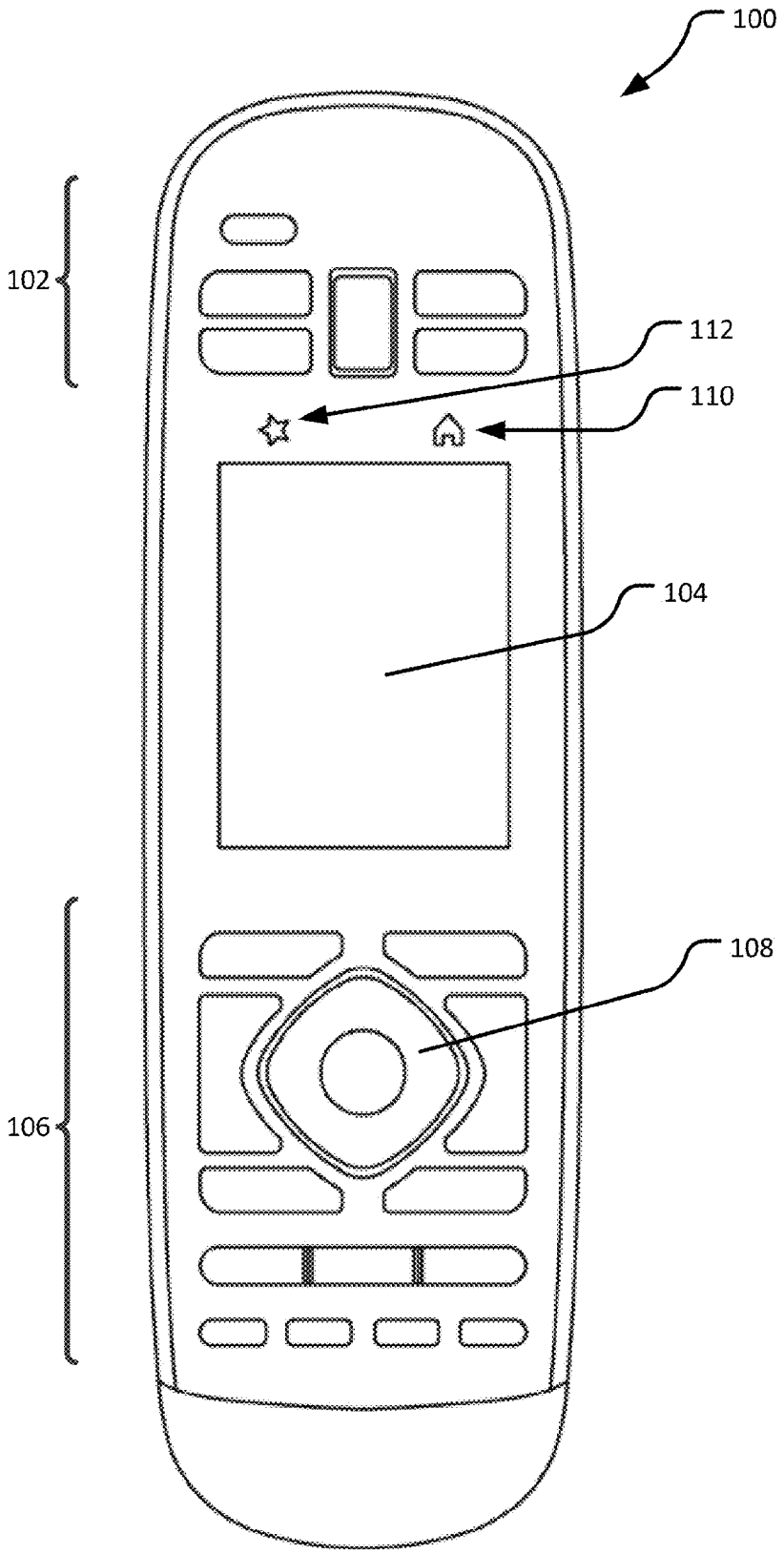
FIG. 1 shows an illustrative example of a remote control in accordance with at least one embodiment.

FIG. 1 shows an illustrative example of a remote control 100, also referred to as a remote controller, in accordance with an embodiment. The remote control 100 in this example has user input mechanisms allocated among three regions: an upper region, a middle region, and a lower region. The upper region, indicated in the drawing as 102, in an embodiment, includes a plurality of buttons used for the purpose of providing user input into the remote control. The buttons may be used for various purposes and numerous configurations are considered as being within the scope of the present disclosure. For example, the buttons in the upper region 102, in an embodiment, may be buttons determined to be the most commonly used by users of remote controls. Example buttons include a play button, a pause button, a record button, a fast forward button, and a rewind button, although numerous other types of buttons may also be in the upper region 102 instead of or in addition to the buttons mentioned. In an embodiment, the buttons in the upper region are mechanical buttons that operate by flipping an electronic switch when displaced. While such buttons are used for the purpose of illustration, numerous other types of buttons and/or other types of user input devices may be used in accordance with the various embodiments. For instance, user input devices may be virtual buttons, such as buttons displayed on a touchscreen and selectable by touching or otherwise interacting with the touchscreen. As another example, buttons may not be displaceable, but may be printed on or in connection with a touch-sensitive surface such that, by touching or otherwise interacting with the surface, the buttons may be selected.

When a user presses one of the buttons in the upper region 102, in an embodiment, the button activates a switch on a circuit located inside of the remote control 100, thereby causing one or more signals to be transmitted to a processor of the circuit which directs other portions of the circuit to act accordingly. For example, when a user presses a button on the remote control, a processor in the remote control 100 may cause a subcircuit to transmit one or more signals corresponding to the button that was pressed. The signals may be transmitted in any suitable manner. For example, the remote control may include an infrared (IR) circuit that transmits IR signals, which are commonly used to control various appliances such as televisions, DVD players, Blu-Ray players, gaming consoles, receivers and other appliances. As another example, the circuit of the remote control may transmit radio frequency (RF) signals to appliances that are able to process such signals. As yet another example, wireless signals may be transmitted to a Wi-Fi receiver which may then, upon receipt of the signals, transmit signals over one or more networks, such as a home network and/or the Internet. For instance, in some examples, Wi-Fi signals may be sent from the remote control to a Wi-Fi receiver, which then, over copper wire, may transmit a signal to another device that reformats the signal into a different type of signal such as IR or RF. Generally, the remote control may transmit signals according to any suitable communication protocol or combination of protocols including those not explicitly mentioned herein.

In the middle portion of the remote control, in an embodiment, is a touchscreen 104. In an embodiment, the touchscreen 104 is a capacitive touchscreen configured to enable users to provide input to the remote control by moving a finger and/or other appendage in contact with and relative to the touchscreen 104. While a capacitive touchscreen is used for the purpose of illustration, any touchscreen or touch-sensitive surface suitable for use in various embodiments described herein may be used. In addition, while touchscreens are used for the purpose of illustration, techniques described herein may be adapted to other user input devices, such as input devices utilizing proximity sensing. For instance, techniques described below are discussed in connection with users interacting with a touchscreen with an appendage (or other object) in contact with the touchscreen. Such techniques may be adapted so that similar gestures may be input without touching the input device by, for example, moving the appendage (or other object) in some specified way in proximity to, but not in contact with, the input device.

Returning to the specific illustrated example illustrated in FIG. 1, the user may make various gestures using the touchscreen 104 in order to provide corresponding user input. For example, a user may slide a finger along the touchscreen 104 from left to right as one gesture, from right to left as another gesture, from the bottom to the top as yet another gesture, and from top to bottom as yet another gesture. As another example, a user may move a finger along the surface of the touchscreen 104 in a manner forming a circle. The direction in which a circle is formed may correspond to different gestures. For example, making a clockwise circle may be a different gesture than a counter-clockwise circle.

Upon user input of a gesture, in using the touchscreen 104, a processor of the remote control 100 may process the input to recognize the gesture and act accordingly, such as by causing a sub-circuit of a circuit on which the processor is situated to transmit one or more signals. Gestures may also be used for other purposes. For instance, in an embodiment, the touchscreen 104 displays a graphical user interface (GUI). Gestures, through the use of the touchscreen 104, may be used to navigate the GUI. For example, the touchscreen 104 may display representations of buttons. Tapping the touchscreen 104 at a location at which a button is displayed may cause the remote control 100 to operate as if that button was pressed. Such buttons may be used to cause the remote control 100 to transmit signals or to navigate a GUI such as by navigating from one page of the GUI to another page.

Other techniques for navigating a touchscreen, such as techniques used in smartphones, tablet computing devices, and other devices, may also be used in a remote control. For instance, for some states of a GUI, a user may navigate through the GUI states by sliding a finger along the touchscreen in a direction corresponding to the navigation, as if the finger is sliding one page out of the way to be replaced by another page. As another example, a user may touch the touchscreen with two fingers and separate the two fingers while in contact with the touchscreen to cause a zoom function to change how the GUI appears. Other techniques may also be used. Indeed, embodiments of the present disclosure include embodiments where an application on a smartphone, tablet computing device, or other device is configured for control of one or more appliances, either by directly transmitting signals to appliances and/or indirectly, such as by transmitting one type of signal to a bridge device that itself transmits a corresponding signal to the appliance (s).

However, embodiments using remote controls whose primary purpose is the direct or indirect control of appliances are particularly useful in numerous circumstances. For example, such handheld remote controls may be physically configured advantageously to provide numerous advantages. For example, as illustrated in FIG. 1, the remote control 100 is configured such that both the buttons in the third region 106 and the touchscreen 104 are within easy reach of the thumbs of typically-sized hands when a user grips the remote control 100 in a natural fashion, that is, how users typically grip remote controls. A natural grip on the remote control 100 may also be reinforced by contours on the side and/or bottom of the remote control 100, although such contours are not shown in the figure. Further, in this example, the buttons in the third region 106 are tactile, thereby making it easier for the user to control appliances without having to look at the remote control, yet the touchscreen provides additional context-sensitive flexibility, such as described herein. As yet another advantage, such handheld remote controls may be optimized to communicate to/with appliances using protocols (line of sight IR, RF, e.g.) that are common for use in appliance controls. Smartphones, tablets, and the like may not include such optimization because their primary use is communication using other protocols, such as Wi-Fi and cellular protocols. In addition, smartphones, tablets, and the like may require additional bridge devices that enable communication with appliances whereas many remote controls in accordance with various embodiments are configured to communicate to/with appliances without the need for a bridge device (although the use of a bridge device is considered as being within the scope of the present disclosure).

The remote control 100, in an embodiment, includes a lower section 106 that includes other buttons which may be used to operate the remote control 100. Buttons of the lower section 106 may be buttons different from those in the upper section 102, although some buttons may be the same. Buttons in the lower section may, as with the buttons in the upper section, be used to provide user input into the remote control to cause the remote control to operate accordingly. For example, buttons of the lower section may include buttons for channel up commands, channel down commands, volume up commands, volume down commands, and generally any other buttons such as buttons available on conventional remote controls. In addition, the lower region 106 of the remote control 100, in an embodiment, includes a five-way key 108 which may be used, for example, to navigate a GUI presented by an appliance. For example, in many instances, a television displays a graphical user interface of the television or of another appliance such as a DVD player. The five-way key may be used to navigate by moving a cursor or other graphical user interface element up, down, left or right in the GUI. A button in the center of the five-way key 108 may be used to make selections of elements in the GUI presented by the appliance, such as selection of currently highlighted elements.

In an embodiment, the remote control 100 includes additional buttons which, unlike the buttons of the upper region and lower region in the illustrative example of FIG. 1, are not mechanical buttons. For example, as illustrated in FIG. 1, just above the touchscreen 104 appears a home button 110. The home button 110 may be selectable by a user of the remote control 100 in order to cause a GUI of the remote control 100 to navigate to a screen designated in memory of the remote control as a home screen. Thus, a user may touch the home button 110 in order to cause the home screen to appear on the touchscreen 104. In this manner, a user may navigate quickly and easily to a familiar screen without having to, for example, hit a back button numerous times and/or otherwise navigate to such a screen. Similarly, the remote control 100, in an embodiment, just above the touchscreen 104, includes a star button 112. The star button 112, in an embodiment, as with the home button 110, is not a mechanical button, but is simply operated by touching the remote control 100 at the location where the star button is located.

Selection of the star button 112, in an embodiment, causes representations of one or more content sources to be displayed on the touchscreen 104. The representations of the content sources may, for instance, be icons representing favorite channels of a user of the remote control 100. Content sources may also correspond to other types of content. For instance, selection of the star button may cause, among other things, an icon representing a television series accessible through an on-line video streaming service such as Netflix to appear. Selection of such an icon may then cause the remote control to transmit one or more signals so that a set of appliances of the user changes state in order to enable the user to watch the content corresponding to the icon. For instance, if a television of the user includes an application that allows video streaming through a video streaming service, selection of an icon representing content of the video streaming service may cause the remote control to transmit signals that cause the television to change state such that the content is displayed on the television. Similarly, other devices, such as content streaming devices separate from televisions may be caused to change state appropriately in response to user selection of a content source. In some embodiments, selectable content sources include sources that are not necessarily sources of pre-recorded multimedia content. For example, a content source may correspond to a user of an Internet-based telephone service, such as Skype. A user may, for instance, select one or more of his/her contacts and, as a result, the remote control may cause a device with a telephone service application to place a call to the selected individual(s). In one embodiment, a system of one or more appliances would be configured to first properly make such a call, and/or would ensure/confirm that that system was in the right configuration, such as by prompting a user for user input requesting such a configuration, perhaps by asking the user if he/she would like to call a particular person and accepting user input corresponding to yes or no. As another example, a content source selectable after selection of the star icon may correspond to a telephone number of a person. The remote control may cause a telephone device, such as a controllable voice over Internet protocol (VOIP) device, to dial the telephone number corresponding to the selection. Generally, the content source may be anything corresponding to content, which is not necessarily pre-recorded, that may be accessed by altering the state of a set of one or more appliances.

Further, content represented on a screen corresponding to the star button may be all of one type (e.g., broadcast TV), or may be from multiple types. For example, a favorites screen (corresponding to the star button) may show 3-broadcast network channels, Netflix, and Skype all on one screen. As an alternative, a GUI may group things together logically like all broadcast content sources on one screen, or all sports related content sources on one screen. Favorite sources of content may be pre-assigned by the user, or may be dynamically created based on analysis of use. (E.g., most frequently accessed content would become favorites automatically, in some embodiments.) Further, as with assignment of favorites, logical groupings may be done by a user and/or by the remote control (or, generally a remote control system) based on monitoring and some information obtained about the content/subject matter associated with the link/activity. For instance, the remote control (or a remote control system) may create links to the CNN TV channel and the ESPN website, that is, selectable GUI elements for causing appliances to provide content from the CNN TV channel and the ESPN website, respectively. In addition, logical groupings of content sources on a screen may also be used. In this manner, broadcast channels may appear together as may Skype contacts.

In an embodiment, the home button 110 and the star button 112 are selectable via the touchscreen 104. For instance, the touchscreen 104 is represented by a rectangular box in FIG. 1, which may be viewable area of a display of a touchscreen 104, that is, an area in which the touchscreen displays an interface and such display of the interface is visible to a user of the remote control. The touch sensitive portion of the touchscreen 104 may, however, extend underneath an opaque portion of a housing of the remote control 100 to the areas occupied by the home button 110 and the star button 112. Thus, selection of the home button 110 and the star button 112 may cause user input to be provided to the remote control 100 through the touchscreen 104, even though the home button 110 and the star button 112 are not located in an area of the touchscreen 104's visible display. The touchscreen's display, however, may be used to illuminate the home button, star button, and/or other buttons by shining light through a portion of the housing of the remote control.

Figure 2:
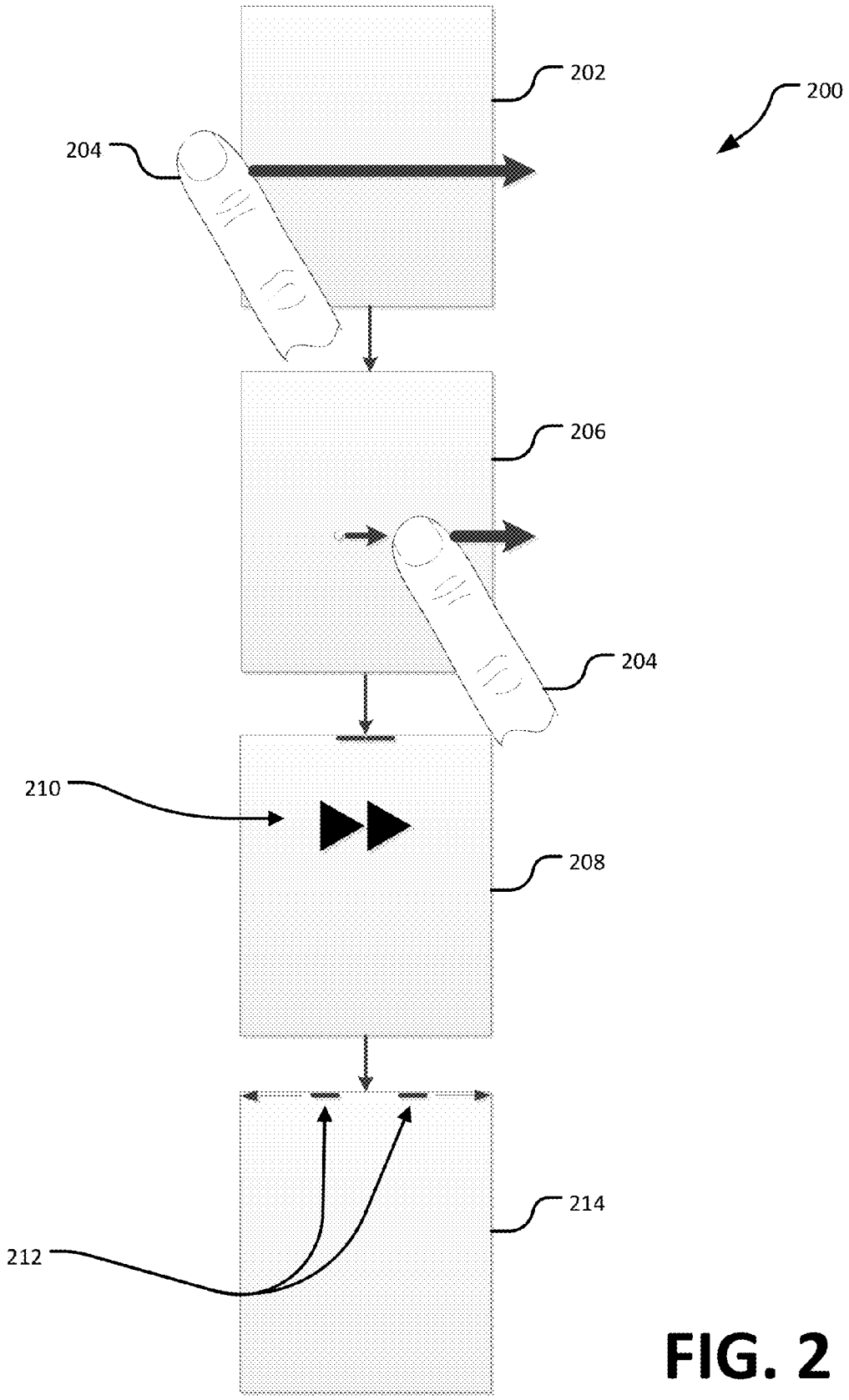
FIG. 2 shows an illustrative example of graphical user interface (GUI) transformations in accordance with user input, in accordance with at least one embodiment.

As mentioned above, various embodiments of the present disclosure include the ability to input, into a touchscreen, gestures in order to operate a remote control. FIG. 2 accordingly shows an illustrative example of one way in which gestures may be used to provide user input to a remote control and feedback may be provided by the remote control accordingly. In particular, FIG. 2 shows a series of screens which may be displayed on a touchscreen 202 of a remote control, such as the touchscreen described above in connection with FIG. 1. It should be noted, however, that the touchscreen may be a component of a remote control such as described above, but may be a touchscreen of another device such as a mobile phone, a tablet computing device or generally any device having a touchscreen or other touch-sensitive surface. Accordingly, it should be noted that, while the phrase "remote control" is used for the purpose of illustration throughout this disclosure, other devices are also considered as being in the scope of the present disclosure. Thus, techniques of the present disclosure are applicable to any devices capable of acting as remote control devices, whether or not those devices have a primary purpose of controlling appliances.

Turning back to the description of FIG. 2, as noted, FIG. 2 shows a first screen 202. A finger 204 of a user is slid in contact with and across the screen 202, as illustrated by the bold arrow moving across the screen 202. In this manner, the user has input a gesture into the remote control. As illustrated by a second screen 206, the touchscreen of the remote control may provide visual and/or other feedback to the user regarding a gesture being input into the remote control. In this example, when the remote control detects interaction with the touchscreen, the touchscreen may display a dot that trails the finger (or other object's) movement across the screen. In this manner, the user receives feedback that his/her gestures are effective and/or that input is being received by the remote control. Producing the dot may be performed in any suitable manner. For example, to achieve lower costs to manufacture a remote control, the remote control may be configured with relatively low processing capacity. With limited processing capacity, the remote control may be programmed to display a dot at a determined location, such as a location of a touch event on the touch screen. The limited processing capacity may then, according to its processing capabilities, actually display the dot at that location significantly after the moving finger has passed that location. In this manner, the dot is visible instead of being under the user's finger without the need for higher processing capacity to determine the proper location for the dot to appear. Of course, higher processing capabilities and programming to achieve an effect such as illustrated in FIG. 2 are considered as being within the scope of the present disclosure. In addition, other effects may be used in addition to or instead of a dot trailing a finger's (or other object's) movement. For example, display elements such as comet tails, line traces, and/or other effects may be used to provide visual or other feedback that the input is recognized.

As a result of the user having slid his or her finger across the screen as illustrated in FIG. 2, a display of the screen 202 may change. Accordingly, as illustrated in FIG. 2, a third screen 208 may appear as a result of the user having moved his or her finger across the touchscreen 104. In this example, displayed in the second screen 208 is an icon 210 representative of a gesture recognized by a remote control. In this illustrative example, the icon 210 represents a fast forward command. Thus, the remote control has determined that the detected motion of the finger 204 across the screen corresponds to a fast forward command. In this manner, a user is able to see how the remote control has interpreted his or her gesture in order to ensure that the remote control has interpreted it correctly, that the correct gesture was used, and/or generally to ensure that the remote control is operating as desired by the user.

In addition, as illustrated in FIG. 2, a transmission representation 212 appears at the top of the third screen 208. The transmission representation 212 is a visual indication that the remote control is transmitting a signal. In this example, the transmission representation 212 is situated at the top of the third screen 208, using one or more rows of pixels forming a perimeter of the display. In this manner, the representation 208 provides feedback to a user that a signal is being transmitted while occupying a minimal portion of the screen. Thus, other portions of the screen may be reserved for other purposes.

As illustrated by a fourth screen 214, the transmission representation 212, in an embodiment, is an animation. In this particular example, the transmission representation 212 comprises two horizontal bars separated horizontally from each other where the animation proceeds such that the bars move away from each other toward respective edges of the screen until the bars reach the edge of the screen and disappear. The bars may disappear by the bars gradually getting smaller while in contact with the edge, thereby giving the effect that the bars are moving off the screen. In this manner, the transmission representation 212 has the appearance indicative of a process happening that is the transmission of one or more signals. It should be noted that numerous variations of the graphical user interface illustrated in FIG. 2 are considered as being within the scope of the present embodiment. For instance, as noted above, numerous types of gestures may be input into a remote control, not just gestures across a touchscreen of the remote control.

While FIG. 2 shows an illustrative example of a particularly useful embodiment, variations are considered as being within the scope of the present disclosure. The movement of the bars, for example, can be adjusted to provide more information to the user. For instance, the velocity of the bars and/or how the velocity changes may indicate some aspect of a remote control's operation. The velocity may indicate how fast the signals are being sent, duration of the signals, pulsing of the signals, etc. The bars may also vary in length—short bars for quick signals, long bars for extended signals. Bars may make repetitive movements to indicate repeated transmission of the same command. The bars could also convey how many signals are being sent. For instance, if two number commands are being transmitted, a remote control may repeat an animation twice. As another example, if two types of commands are being sent, such as power then a channel, the remote control may repeat the animation twice. Other variations are also possible.

Generally, various embodiments of the present disclosure include embodiments whereby the user inputs a gesture into the remote control and the remote control provides visual feedback indicative of how the remote control has interpreted the gesture. Gestures may be mapped to commands and therefore, upon detection of a gesture, the remote control may provide a visual indication of which command corresponds to the gesture which was detected. In addition, the various embodiments of the present disclosure also include numerous other embodiments wherein both a representation of a recognized gesture is displayed and a visual indication that a signal is being transmitted when the remote control is transmitting signals. Also, it should be noted that the various icons and other representations explicitly illustrated herein are just provided for the purpose of illustration and that other representations may also be used. For instance, in an embodiment, instead of moving across a perimeter of a display of a touchscreen, in some embodiments, animations are configured to appear as if signals are radiating from a central point, such as from a central area of the display. In addition, when using the perimeter of a display, animations may proceed among other sides of the rectangle such as the left and right sides illustrated in FIG. 2. In addition, the display area of a touchscreen need not be rectangular, although rectangles are provided for the purpose of illustration. For example, the animation illustrated in FIG. 2 may be accomplished along the perimeter of any shaped object such as a circle, triangle, square, rectangle or general polygon. By animating objects along the perimeter of a display, an advantage is achieved in that useful information is conveyed to the user while taking relatively little display space and, in many embodiments, not requiring other portions of the display to change to accommodate the animation.

It should also be noted that a display area of the screens shown in FIG. 2 and in other figures herein are illustrative in nature and the screens may display different and/or other information. For example, a display screen may show what mode the remote control is in, may show a battery level, may show a time and/or date, and generally any information may be shown on the screen. In addition, FIG. 2 and other figures herein show transitions between various GUI states. Additional or fewer transitions are considered as being within the scope of the present disclosure. For instance, additional GUI states may appear and, therefore, the transitions illustrated in FIG. 2 need not be direct transitions in all embodiments.

Figure 3:
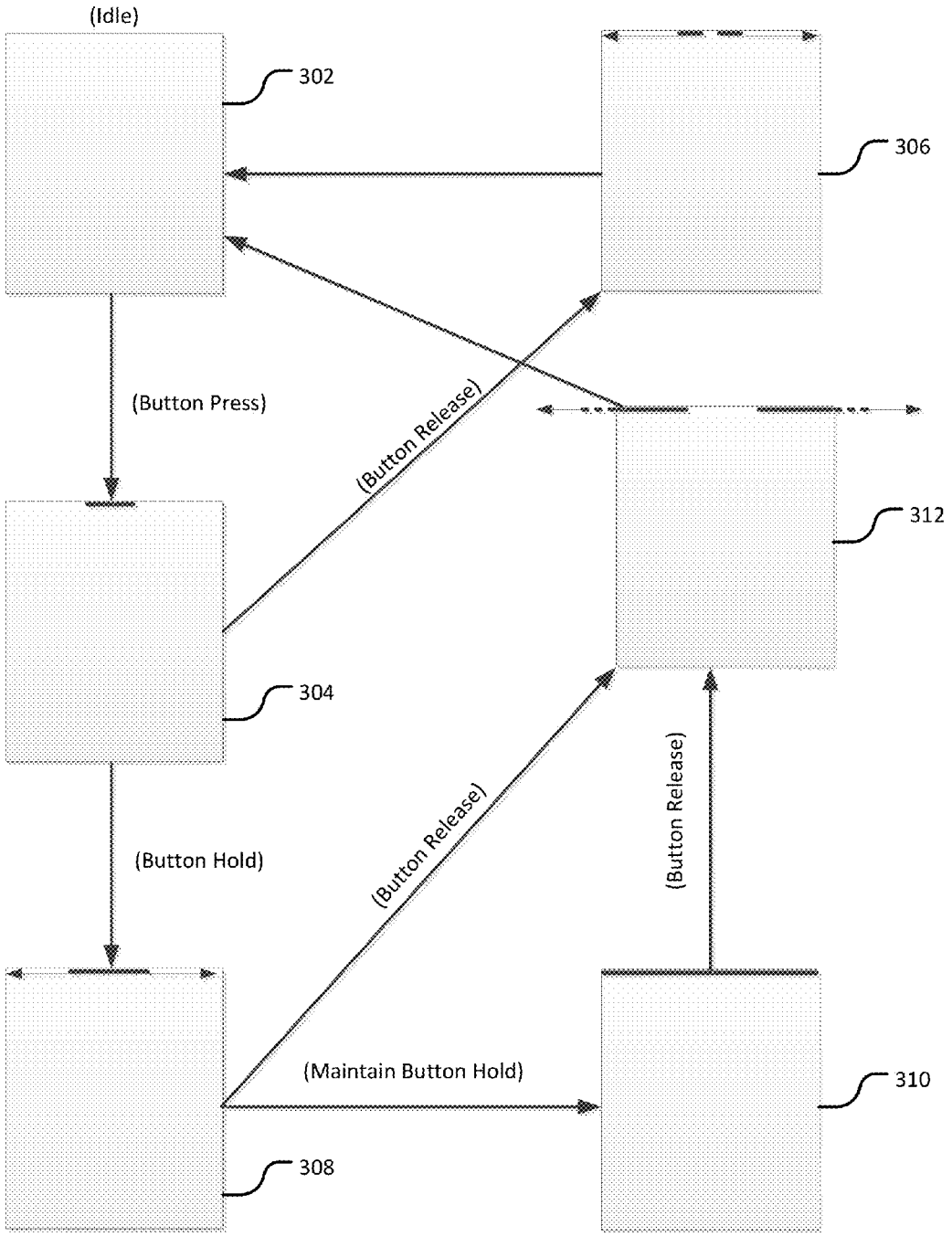
FIG. 3 shows another illustrative example of GUI transformations in accordance with user input, in accordance with at least one embodiment.

Embodiments of the present disclosure allow for robust feedback to users related to the transmission of signals. For instance, FIG. 2 shows an illustrative example of how the transmission of one or more signals may be represented on a display in accordance with an embodiment. FIG. 3 shows another example of how a display may operate in order to provide robust feedback to users regarding the transmission of signals. In particular, FIG. 3 shows various screens of a GUI and arrows between the screens indicate possible transitions from one to the other which, as noted above, need not be direct transitions. As illustrated in FIG. 3, a first screen 302 indicates a display of a remote control when the remote control is in an idle state, that is, when the remote control is not provided user input to the remote control. It should be noted that, while blank in FIG. 3, information may be shown when the remote control is in an idle state.

By pressing a button on the remote control, which may be a mechanical button, a virtual button of the touchscreen, or another type of button, a second screen 304 may appear. Dependent on whether the selection of the button corresponds to transmission of a signal from the remote control (e.g., to control an appliance), in accordance with an embodiment, a thin rectangle may appear at the top of the second screen 304, such as illustrated in FIG. 3. The thin rectangle may have a small thickness relative to the rest of the display. For instance, in some embodiments, the rectangle has a height of a single pixel (or more pixels). The rectangle may be a thick line or, generally, a rectangle with a greater height than illustrated. From the second screen 304, different screens may appear depending on whether the user immediately releases the button or holds the button down.

For instance, in an embodiment, if the button is immediately released, the display may appear as illustrated by the third screen 306 of FIG. 3. In particular, the narrow rectangle at the top of the screen may separate into two rectangles which may be animated so as to appear to move toward respective edges of the screen such as described above in connection with FIG. 2.

If, however, the button is held, the fourth screen 308 may appear. The fourth screen, as illustrated, shows the rectangle at the top of the screen getting wider while the button is held until, as illustrated by a fifth screen 310, the narrow rectangle at the top of the screen occupies a full row of pixels across the top of the screen. This provides the user visual feedback that the button hold being input into the remote control is recognized since the user is able to see the rectangle change while the user engages in a motionless action (button hold). The rectangle at the top of the screen may remain as illustrated by the fifth screen 310 until the button is released. Further enhancements may also be made in various embodiments, such as by animating the line while it fills the top of the screen, such as by varying the line's coloring, shading, thickness, and/or other visual characteristics. At this time, the screen may appear as a sixth screen 312, where the bar animates in a manner giving the impression that the bar breaks into two halves which appear to move off the screen along the upper edge of the screen, as indicated by the dotted portion of the bars shown in the sixth screen 312. (It should be noted that the dotted portion of the lines may not actually be drawn by a touchscreen, but are included in the figure to illustrate the effect.) This may be accomplished, for example, by shrinking the bars with their outer ends stationary against respective opposing edges of the touchscreen. In this manner, an animation representative of signal transmission of a remote control may proceed in a three-stage (or more than three stages) process where the animation changes according to how the button is pressed. Thus, the user may ensure, for example, that signals are being transmitted while the user holds the button and that signal transmission stops upon release of the button. In other words, the user receives feedback throughout the whole process that the input is being received and that, if appropriate, signals are being transmitted from the remote control.

Figure 4:
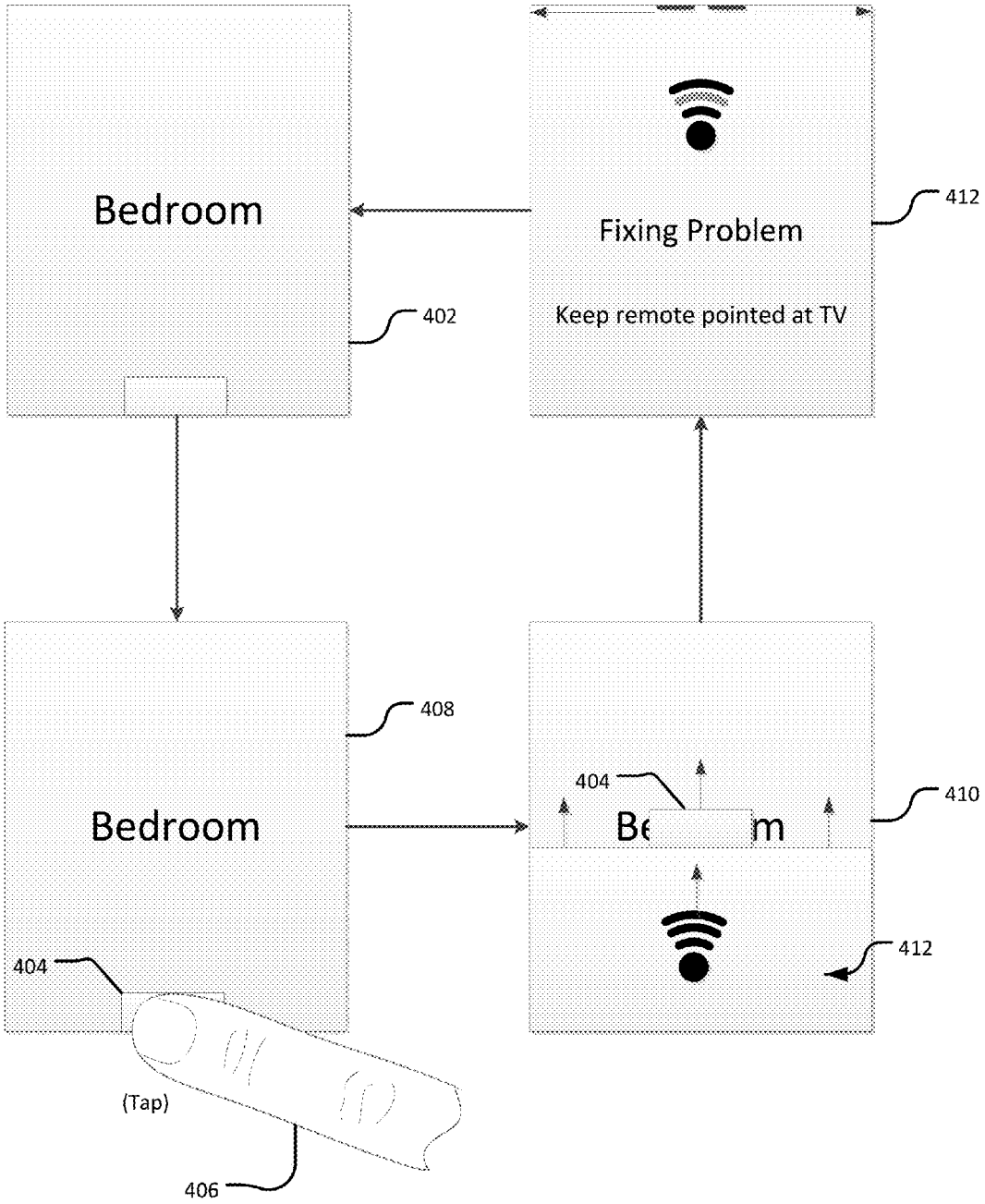
FIG. 4 shows yet another illustrative example of GUI transformations in accordance with user input, in accordance with at least one embodiment.

FIG. 4 shows another illustrative example of how robust feedback may be provided to a user of a remote control. FIG. 4, as with FIGS. 2 and 3, shows multiple screens and arrows between the screens to indicate transitions of a graphical user interface, which are not necessarily direct transitions. For example, a first display screen 402 appears in the upper left corner of the figure. In this example, the screen 402 may be a screen such as the screen above when the remote control is in an idle stage. In this particular example, the word "bedroom" appears in the center of the screen to provide an indication of which mode for controlling devices the remote control is in. The mode may correspond to a particular user setup. For instance, the user may have configured his or her remote control to control a setup of one or more appliances in the user's bedroom. In an embodiment, the display screen 402 includes a representation of a tab 404, often referred to as a "peek tab." The representation of the tab 404 in this example protrudes from the bottom area of the display to indicate to the user that the tab is an element of a GUI that may be manipulated by the user. In this particular example, the user may click the tab, such as by tapping on the touchscreen at the location where the tab is displayed. Other ways of manipulating the tab are also within the scope of the present disclosure. For example, a user may place his or her finger 406 on the tab 404 and then slide his or her finger 406 upward in order to pull the tab to the top of the screen. It should be noted that the various techniques illustrated and described in connection with FIG. 4 are not limited to techniques used in connection with GUI tabs or other such elements, but are generally applicable in numerous additional contexts.

A second display screen 408 in FIG. 4 illustrates how the user may use his or her finger 406 to cause the tab 404 to move towards the top of the screen with a touch of the tab on the touchscreen. As illustrated in a third screen 410 of FIG. 4, as a result of the user using his or her finger 406 to tap the tab 404, the display 410 appears to change as if a sheet is being slid in the direction slid by the finger, with content to be displayed on the sheet moving with the sheet. When the sheet is at the top of the screen, the display may appear as illustrated by a fourth display screen 414 where the tab 404 disappears and the sheet 412 has the appearance of covering the whole display. The fourth screen 414, in an embodiment, includes visual indications of what the remote control is currently doing as well as animations illustrating that the remote control is transmitting one or more signals. As shown, one animation may be, for example, an animation similar to one of those described above where bars separate along a top edge of the screen. This animation may repeat for each signal transmitted, thereby giving an accurate visual representation of what the remote control is actually doing. As an alternative, the animation may repeat periodically while the remote is transmitting signals, where each repetition does not necessarily correspond to a signal transmission. Rather, in this example, the repeated animation generally indicates that the remote control is transmitting signals. In an embodiment, the horizontal bar animation begins immediately after (or otherwise in close proximity to) the sheet reaching the top of the display. In this manner, the user experiences the GUI transition process as a continuation motion. For instance, in this example, the user pulls up the sheet and as soon as it gets to the top, the user receives feedback that signals are being sent to resolve the problem. This is more interactive than conventional methods of providing feedback and, therefore, more useful to the user.

In some instances, the remote control may also not be correctly configured to perform the desired action. The remote control may include programming logic that enables the remote control to figure out what the problem is in the control signals. For example, the user may have selected HDMI Input 2 as the input setting for a television. The first time the user launches a help interface, the remote control may try setting the input of the television to HDMI Input 2 again (to resolve signal not received). If that did not work and the user selects help again (or otherwise indicates that the proposed solution did not work), the remote control may instead send a HDMI Input 1 command (either based on information about the TV or based on programming logic, such as logic for toggling through input modes). With respect to information about the television, the information may indicate that the television only has two HDMI inputs (and hence determines to try the other of two HDMI inputs), that HDMI Input 1 is the most common input for the television, and/or that an examination of a history of usage of the remote control indicates that HDMI Input 1 is an input that is frequently used. The history of the remote may be that often after a user selects a specific action, a manual command to change to HDMI Input 1 is entered. A further option is that the remote control could learn this activity and change the commands associated with an action based on what is likely to result in the desired state (based on this history analysis). Example techniques for learning a user's desired end state for a set of one or more appliances appear below.

A second animation, in this example, is an animated icon represented of signal transmission. This particular icon includes a circle above which three circular segments of varying size are laid. The circular segments may change color in a sequential pattern, thereby visually representing the transmission of signals. Additional information may also be displayed and the various embodiments are not limited to those explicitly illustrated. For instance, the touchscreen or other display may display a message indicating which command is being transmitted. The screen may, for example, display messages such as "Turning on TV," "Turning on Satellite," "Changing TV Input Mode," and/or other such messages that correspond to actions currently being taken by the remote control. In addition, information about the type of signal (e.g., IR or RF) may also be displayed.

In this particular illustrative example, the tab 404 corresponds to a help tab that the user may tap as illustrated in FIG. 4 in order to cause the remote control to fix a problem with one or more appliances. As just an example, the user may have wanted to watch television, which may involve one or more appliances (e.g., a television and a satellite receiver). The user may, for instance, have indicated the desire to watch television by selecting a "Watch Television" activity of the remote control, or perhaps by selecting a "Bedroom" activity, which corresponds to watching TV. The remote control may have then transmitted one or more signals encoding commands for the television and receiver to be in an appropriate state for watching TV. For example, the remote control may have transmitted power commands to the television and receiver and a command for the television to be in an input mode that enables the television to receive audio/video signals from the receiver. Volume and channel commands may also be transmitted. Despite the transmission of the commands, one or more of those appliances may not be in a correct state. For example, somebody may have walked in front of the remote control during transmission of an IR command, thereby causing the signal encoding the IR command to be blocked from reaching the signal's intended appliance. As another example, something may have caused a state tracking remote control to have incorrect current state data and, as a result, sent an incorrect command, such as a power toggle command for an appliance that was already turned on.

Providing user input that causes the tab 404 to slide to the top of the screen, as illustrated in FIG. 4, may therefore cause the remote control to attempt to put an appliance in the right state. Putting an appliance in the right state may be accomplished in any suitable manner. For instance, in certain activities such as watching TV, and depending on the appliances used, there may be common issues. For instance, a common issue may be that the TV operates by a power toggle command and thus sliding the tab 404 to the top of the screen may cause the remote control to transmit the power toggle command again in order to put the television in the right state, that is, in a power on state. Similarly, a command that toggles among input modes may be transmitted to cause a television to toggle through a set of possible input modes. The animation of the fourth screen 414 may repeat as the remote control transmits signals in order to fix one or more problems.

Figure 5:
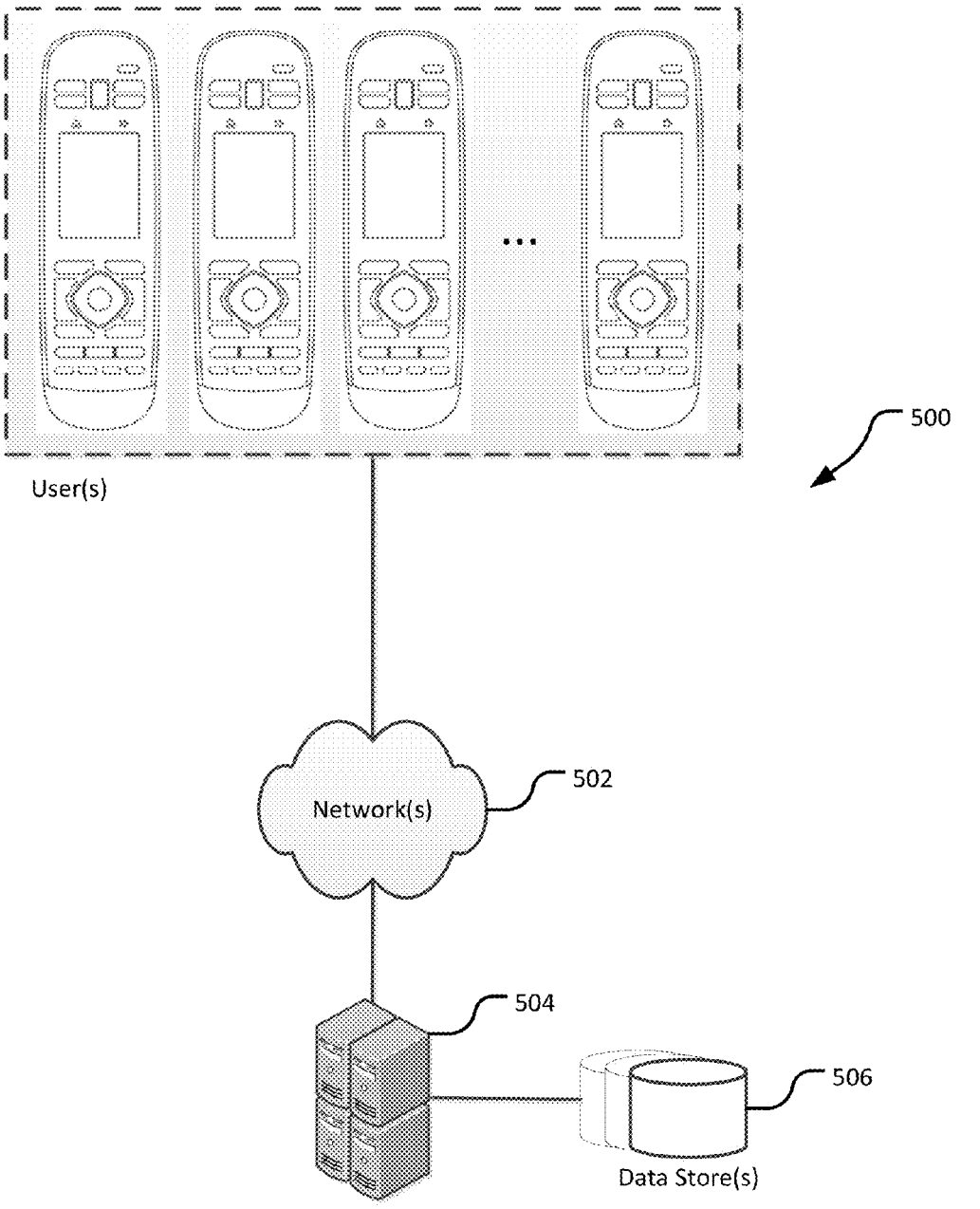
FIG. 5 shows an illustrative example of an environment that may be used to configure remote controls in accordance with at least one embodiment.

Various embodiments of the present disclosure allow users to customize their remote controls according to their particular inventory of appliances. FIG. 5 therefore shows an illustrative example of an environment in which users may configure their remote controls. In an embodiment, remote controls are configured over one or more networks 502, which may be any suitable communication network or combination of networks, including, but not limited to, intranets, the Internet, mobile communication networks, and the like. In the example, users can configure their remote control by communication with a server or cluster of servers 504 that are configured to enable users to configure the remote controls according to users' particular inventory and preferences. For example, users may, through a web interface provided by the servers 504, input to the servers 504 information about his or her appliances and how those appliances are connected together and used for various activities such as watching TV, watching movies, and the like. The servers 504 may be operatively connected with one or more data stores 506 which have data for remote control configuration. For example, the data stores may include IR commands and libraries for various appliances as well as timing information for various commands and/or appliances (e.g., so that appropriate pauses between commands may be inserted into macros to allow appliances time to transition between states). For instance, if the user inputs that he or she has an appliance that uses IR, the data stores may be referenced by the servers 504 to obtain data that will enable configurations of the remote for transmission of signals acceptable by that appliance. Other data may also be stored by the data stores 506 such as user profiles, inventories of user appliances, specific user settings, and the like. The servers may include application servers that dynamically generate appropriate configuration data for remote controls based on user input provided by the users.

Information about the layout of the remote control may also be taken into consideration. For example, the display screen of the remote control may be configured to display representations for five commands (e.g., change input, aspect ratio, root menu, skip forward, skip back, etc.). Logic may be used to configure the list and layout of these commands for the remote control. For example, if a remote control has five slots for representations of commands on the screen (or on each page of a multi-page portion of the GUI), similar commands may be grouped together. For example, the skip forward and skip back command may appear on the same page in various embodiments. This may, for example, avoid a poor user experience if one of these functions were on one page, and the other on another page, as it would be common for these to be used together. For example, a "commercial skip" command used in connection with digital video recorders (DVRs) may cause a DVR to skip and/or fast forward an amount of time, such as thirty seconds. If the DVR went forward too far, the user may want to go back immediately. It would be inconvenient to have to change screens to do this.

Configuration data for the remote controls may be provided to the remote controls in any suitable manner. For example, in some embodiments, the remote controls are connected to personal computers (e.g., through a universal serial bus (USB) interface) that connect to the servers. The personal computers may be used by users to input information that is used by the servers to obtain appropriate configuration data. In some embodiments, however, the remote controls themselves have the ability to communicate over the network(s) 502 and connect to the servers themselves. As one example, the remote controls may be remote control applicants on smartphone or tablet computing devices that themselves have network communication technology. In such embodiments, users may input data to the servers through the remote controls. As another example, the remote controls themselves connect to servers to receive configuration data, but users input information to the servers through a UI provided on another device, such as a personal computer. Other variations are also considered as being within the scope of the present disclosure.

Figure 6:
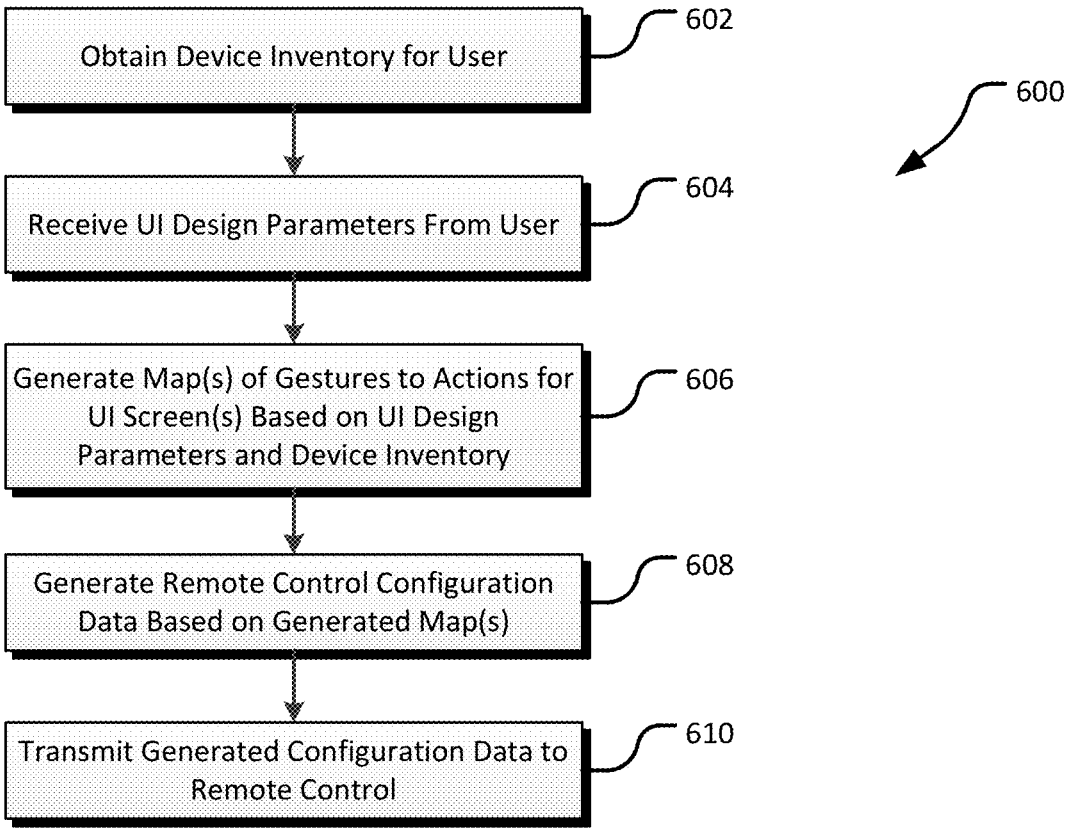
FIG. 6 shows an illustrative example of a process for configuring a remote control in accordance with at least one embodiment.

As noted, the present disclosure is not limited to the particular environment illustrated in FIG. 5 and the techniques described herein, including various processes that can be utilized in multiple different environments. FIG. 6 shows an illustrative example of a process 600 which may be used to configure a remote control in accordance with the various embodiments described herein. The process 600 may be performed, for example, using environments such the environment described above in connection with FIG. 5, although numerous other environments are considered to be within the scope of the present disclosure. Some or all of the process 600 (or any other processes described herein, or variations and/or combinations thereof) may be performed under the control of one or more computer systems configured with executable instructions and may be implemented as code (e.g., executable instructions, one or more computer programs or one or more applications) executing collectively on one or more processors, by hardware or combinations thereof. The code may be stored on a computer-readable storage medium, for example, in the form of a computer program comprising a plurality of instructions executable by one or more processors. The computer-readable storage medium may be non-transitory. An example device that may perform some or all of the process 600 is a server or cluster of servers described above in connection with FIG. 5, although other devices may perform the process 600.

In an embodiment, the process 600 includes obtaining 602 a device inventory for a user of a remote control. Obtaining the device inventory may be done in any suitable manner. For example, in an embodiment, a device inventory may be obtained in accordance with user input provided by user into a web page or other interface and transmitted across a network to a server, such as described above. As another example, a user may provide other information about his or her devices and device inventory may be derived therefrom. For example, the user may provide one or more electronic images of their devices and image recognition techniques may be utilized to determine which devices are in the electronic image. In another embodiment, devices may generate a QR code that encodes their model, serial #, manufacturer, etc, and display those codes on a display device connected to the system (like the TV). The devices may generate these codes, or a central device may poll the devices in the system and generate the codes. For example, programming logic for doing this may be in a television that obtains information over a consumer electronics control (CEC) bus. Individual codes may be generated for each device, or information about multiple devices may be combined into a single code. The code could then be read by the remote control, or another device such as a mobile phone camera, and then set to the server (directly, or first to the remote). The QR codes could then be used to determine the configuration of the system. Alternately, the TV could poll other devices and generate a code, which may be a string of digits, such as 834932. The user could then manually enter that code and the server could interpret the code to know what devices are in the system and/or how the devices are connected/communicating with each other.

In an embodiment, the process 600 also includes receiving 604 UI design parameters from the user. For instance, a web page or other interface may be presented to the user and the user may customize an interface for a remote control. Customizing the interface may be done in any suitable way and customization techniques vary among the various embodiments of the present disclosure. For example, users may select which icons appear and may configure various UI screens and the transitions between them and perform other manipulations in designing a UI customized for the user of a remote control. As another example, users may select UI screens and may select which gestures correspond with which commands in those screens. For example, in one screen, a slide across a screen, such as described above, may correspond to fast forward. Such may be useful, for instance, when a user is in an activity in which the user is watching a movie or other prerecorded content, such as through a streaming service, by playing a DVD, or otherwise. However, a swipe across the screen such as described above may correspond to a channel up command when the user is using the remote to watch TV. Thus, generally, users are able to use the same gesture for different commands depending on the state of the UI of the remote control. In this manner, a more intuitive user interface is provided since the same gesture may intuitively correspond to different commands (or sets of commands) in different contexts.

Upon receiving the UI design parameters from the user and the device inventory, one or more maps of gestures to actions for UI screens, based on UI design parameters and device inventory, are generated 606. A map may be an electronically stored representation of associations among gestures, commands (or sets of commands), UI states (e.g., UI screens), and/or other information. The map may be used by a remote control to ensure that user input is interpreted correctly. In an embodiment, remote control configuration data is then generated 608 based at least in part on the generated maps. Configuration data may be any data used to configure a remote control and the format and structure of configuration data may vary among the different embodiments. For example, configuration data may encode the UI screens themselves. As another example, configuration data may be data used to populate templates stored on a remote control for generating UI screens and for commanding appliances from those UI screens. Generally, the configuration data may be any data usable to configure a remote control, depending on a particular remote control's particular method of being configured.

The generated configuration data may then be transmitted 610 to the remote control. Transmitting the configuration data may be performed in any suitable manner. For example, in some embodiments, the server transmits configuration to the remote control through a network to a personal computer of a user. The personal computer may then include an application, which may be a stand-alone application, browser plugin, or other suitable application that transmits the configuration data through an appropriate interface such as a universal serial bus (USB) interface or in any suitable manner, which may include wireless transmission of configuration data to the remote control over a wireless communication protocol, such as Bluetooth, Wi-Fi, and/or other protocol. Similarly, if a remote control has the ability to be configured with such abilities, the server may communicate directly with the remote control.

Figure 7:
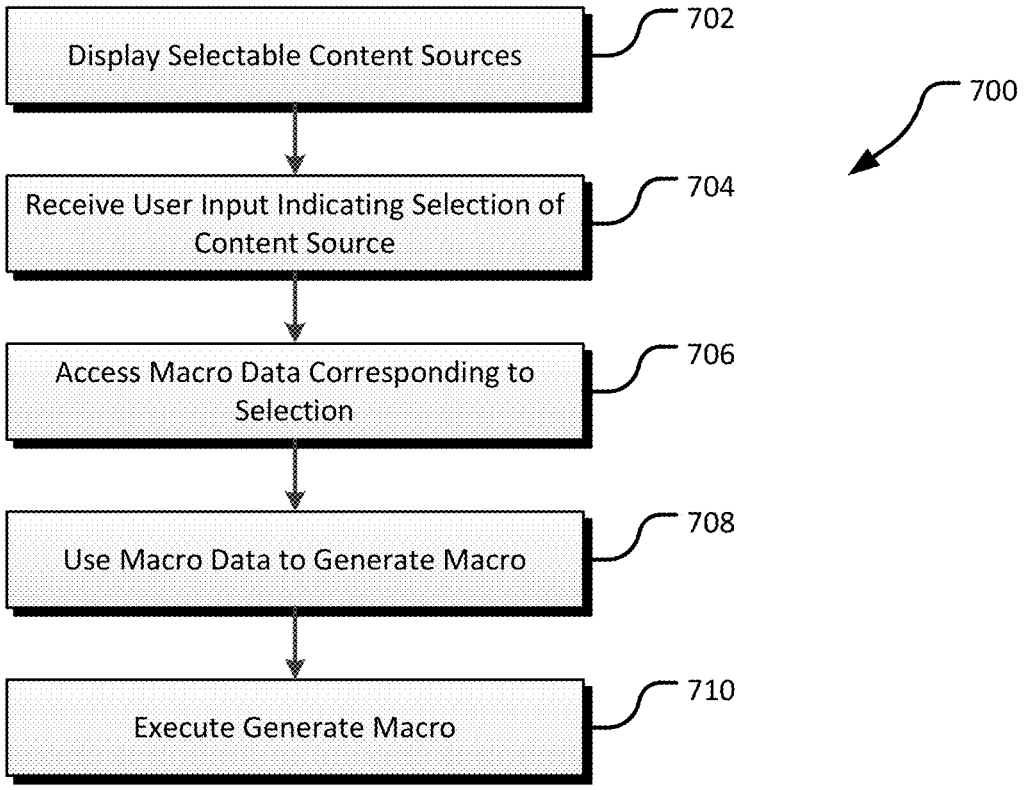
FIG. 7 shows an illustrative example of a process for executing a macro in accordance with at least one embodiment.

As noted, various embodiments of the present disclosure include novel approaches to use of a remote control to control one or more appliances. FIG. 7, for example, shows an illustrative example of a process 700 which may be used to dynamically generate macros in order to control one or more appliances. In an embodiment, process 700 includes displaying 702 selectable content sources. Displaying selectable content sources may be performed, for example, using a display screen of a touchscreen of a remote control such as described above. Displaying the selectable content sources may be performed in any suitable manner, including in manners described above. For example, displaying selectable content sources may include selecting numbers, call letters, or other icons representative of broadcast channels. As another example, displaying selectable content sources may be performed by displaying representations of content accessible through a video streaming service, such as movies or television shows in a Netflix queue or other list of content instances (e.g., shows) that a user has selected from among a larger set of content instances. As yet another example, displaying selectable content sources may be performed by selecting graphical representations of stations (e.g., a textual descriptor) for a radio streaming service such as Pandora. Generally, displaying selectable content sources may be performed in any suitable manner. In addition, multiple different types of selectable content sources may be provided simultaneously and/or on multiple UI screens. For example, displaying selectable content sources may be made by displaying successive UI screens to a user either automatically or pursuant to user navigational input into a remote control.

In an embodiment, the process 700 also includes receiving 704 user input indicating selection of a content source. The user may, for example, tap a touchscreen of the remote control at a location in which a representation of the content source is displayed. As a result of the user having touched the screen in this manner, appropriate signals may be transmitted to a processor associated with a remote control device performing the processing 700. Upon receipt of the user input indicating the selection of the content source, in an embodiment, the process 700 includes accessing 706 macro data corresponding to the selection. Accessing macro data according to the selection may be done, for example, by obtaining the macro selection data from memory according to a stored association of the selectable content sources and the macro data. For example, a device performing the process 700 may store a database that associates selectable content sources with appropriate macro data.

In an embodiment, the process 700 includes using the 708 macro data to generate the macro. As an illustrative example, if a user selects a content source corresponding to a broadcast channel, a remote control may access 706 macro data corresponding to macros for putting a set of appliances in a state suitable for watching television. A device may then use 708 that accessed macro data to generate a macro suitable for watching television, particularly the selected broadcast channel. For example, the accessed macro data may include data indicating a macro that turns a TV and/or other appliances to a proper state. Using the macro data to generate a macro may include adding to that macro commands for tuning to the selected channel. Upon generation 708 of the macro, the macro is then executed 710. Executing the macro may be performed, for example, by transmitting appropriate signals (with appropriate timing between signals to allow time for state transitions of appliances) to appropriate appliances to allow the content from the selected content source to be presented to the user accordingly.

Figure 8:
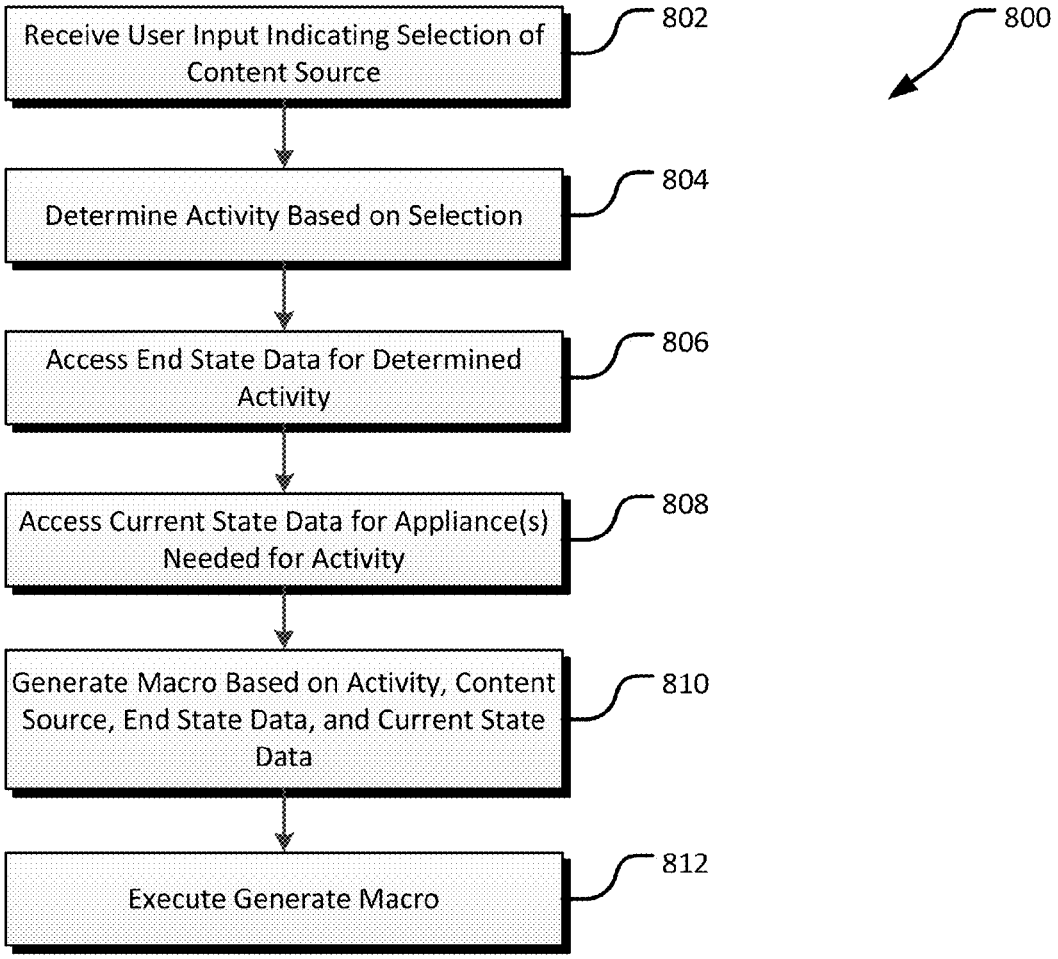
FIG. 8 shows an illustrative example of another process for executing a macro in accordance with at least one embodiment.

Various embodiments of the present disclosure also include tracking the state of various appliances and using that tracked state in order to more effectively control the appliances. FIG. 8, for example, shows an illustrative example of a process 800 for executing a macro in accordance with an embodiment. The process 800, in many ways, is similar to the process 700 described above. However, the process 800 in this example includes the use of state data in order to more effectively generate macros. In an embodiment, user input indicating selection of a content source is received 802 and an activity based on the selection is then determined 804. An activity may be a logical representation of a mode of experiencing content that corresponds to appliances in a particular set of appliances being in a particular state. Such activities may be, for example, watching TV, watching a video streaming service, listening to an Internet radio streaming service, listening to music through a CD player, interacting with an Internet video calling application (Skype, e.g.), playing video games, interacting with an Internet browser, and the like.

In an embodiment, the process 806 includes accessing end state data for the determined activity. In an embodiment, end state data is data that is indicative of the state of a set of one or more appliances suitable for the appliances to participate in the activity. For example, if a user watches television using a set top box to obtain broadcast channel data from a cable company, and uses a receiver to provide audio for watching TV, the end state data may indicate that the television should be turned on, the receiver should be turned on, and the set top box should be turned on, and each of those devices should be set in a particular manner. For example, a TV should be configured to obtain video data from the set top box by being set to a proper input, and likewise a receiver should be set to a setting that enables the receiver to receive audio data from a set top box. Volume and other settings may also be specifications for an activity. As another example, if an appliance includes an application for video calling service, the end state data may indicate that the application should be running, that the application should have authenticated itself with a server, a video camera should be powered on, and the like.

In an embodiment, the process 800 also includes accessing current state data for the appliances needed for the activity. In an embodiment, a remote control (or other device in an environment of appliances) tracks the state of various appliances which it controls. Tracking the state may be done in any suitable manner. For example, some appliances may provide state data to a remote control through a network or otherwise such as by transmitting signals to the remote control. As another example, the remote control may include or may receive data from various sensors that sense the state of the appliance. For example, if a television is on, various sensors may be used to detect light from a television in order to indicate that the television is on.

Similarly, the current state data may also be simulated. Simulated current state data may be data that is not sensed or explicitly provided to the remote control by the appliances, but that the remote control, or another device working in connection with the remote control, tracks itself. Simulated data may be maintained based in part on transmissions that may have been made by the remote control and/or user input to the remote control. For example, if a remote control transmits a power toggle command, the remote control (or a separate device monitoring transmissions from the remote control) may update current state data to toggle between power on and power off.

In an embodiment, the process 800 includes generating 810 a macro based at least in part on the activity, the content source, the end state data, and the current state data. Generating the macro may be performed by comparing current state data with end state data and determining whether commands should be transmitted to various appliances involved in the activity. The determination may be made, for example, dependent on whether the current state data for a particular appliance matches the end state data. As an illustrative example, if the current state data for an appliance indicates that the appliance is in a power off state, a determination may be made to issue a power on or power toggle command. As another example, if the current state data indicates that an appliance is set to an input mode that is different than indicated in the end state data, a determination may be made to issue one or more commands to cause the appliance to be in the proper input mode indicated by the end state data. Generally, any aspect of an appliance's state may be used to determine whether to transmit commands to one or more appliances. Once generated, the generated macro may then be executed 812, such as described above.

Figure 9:
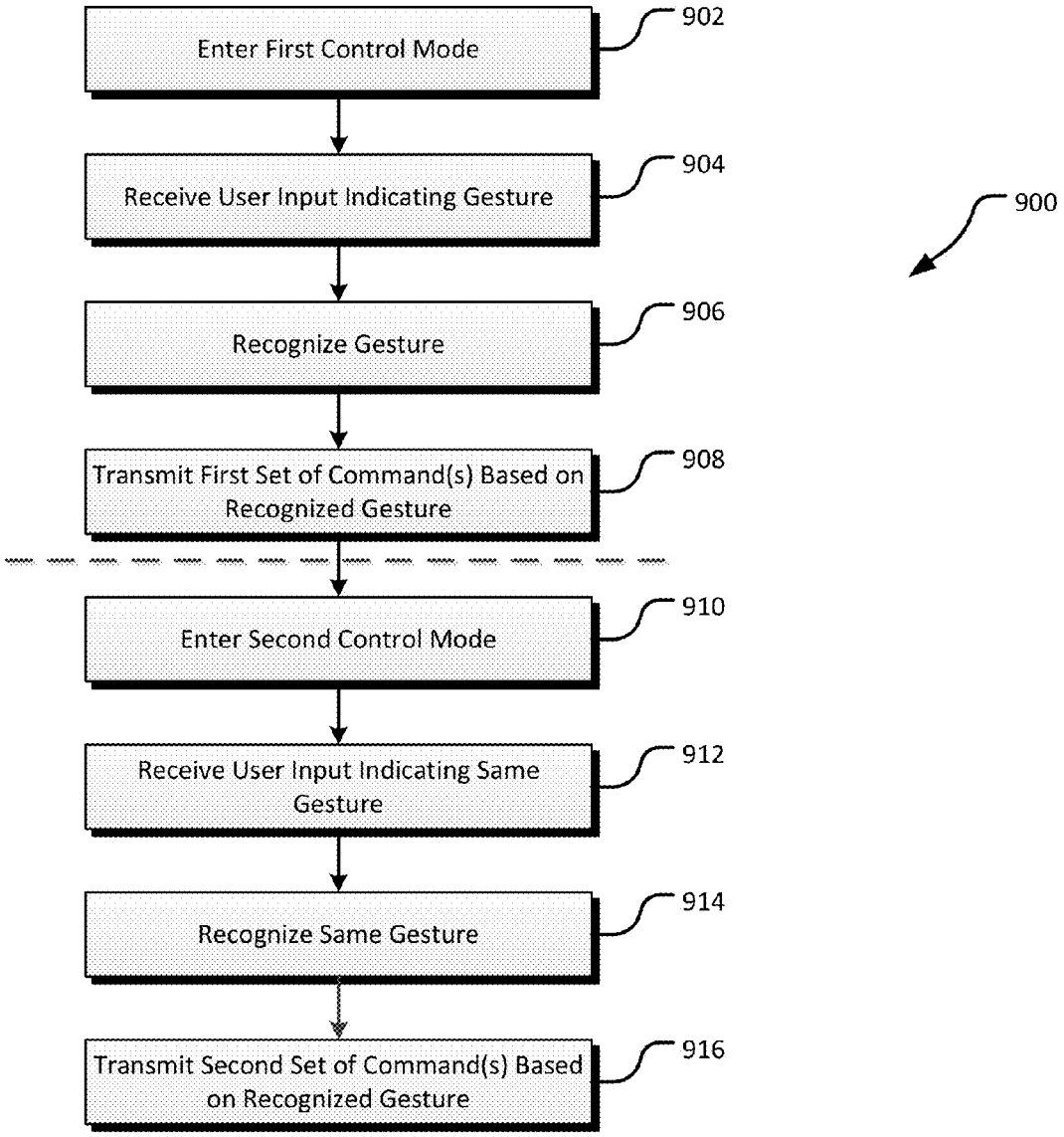
FIG. 9 shows an illustrative example of a process for controlling a set of appliances in accordance with at least one embodiment.

As noted above, various embodiments of the present disclosure allow for use of the touchscreen of a remote control in a manner that is context-sensitive. For example, a particular gesture input into the remote control, when the remote control is in one mode, may cause the remote to take one or more actions that are different from one or more actions that may be taken by the remote control when the same gesture is input into the remote control when the remote control is in another mode. FIG. 9 accordingly shows an illustrative example of a process 900 which may be used to control one or more appliances. A remote control, such as described above, may perform the process 900, as may any suitable device, such as a device working in connection with a remote control to control one or more appliances. In an embodiment, the process 900 includes entering 902 a first control mode. The first control mode may be, for example, a mode corresponding to a selected activity, a mode used to control a particular appliance and/or the like. A control mode may, therefore, correspond to a particular configuration of a remote control used by the remote control while in the mode. The configuration may have a particular mapping of buttons or other input devices to commands, may have corresponding UI screens, and the like. For example, in a Watch TV control mode, certain inputs may correspond to commands useful in watching TV (volume commands, channel changing commands, and the like). Some or all of these inputs may correspond to other commands when in a different control mode.

User input may then be received 904 indicating a gesture such as described above. The gesture may then be recognized 906 and a first set of one or more commands may be transmitted 908 based at least in part on the recognized gesture. At some point later, the process 900 includes entering 910 a second control mode. The second control mode may be different from the first control mode. As noted by the dotted line traversing FIG. 9, a significant amount of time may pass between transmission of the first set of commands and entering the second control mode. It should be noted that the dotted line is provided for the purpose of illustration and that other long significant time periods may also be present in performance of any of the processes described herein, even though such dotted lines are not necessarily explicitly illustrated. Similarly, a significantly long period of time is not necessary when a figure shows a dotted line. In an embodiment, the process 900 also includes receiving 912 user input indicating the same gesture as above. Accordingly, the process 900 includes recognizing 914 the same gesture. However, because a second control mode has been entered, the process at this point in an embodiment includes transmitting 916 a second set of commands based on the recognized gesture where the second set of one or more commands is different from the first set of one or more commands.

Figure 10:
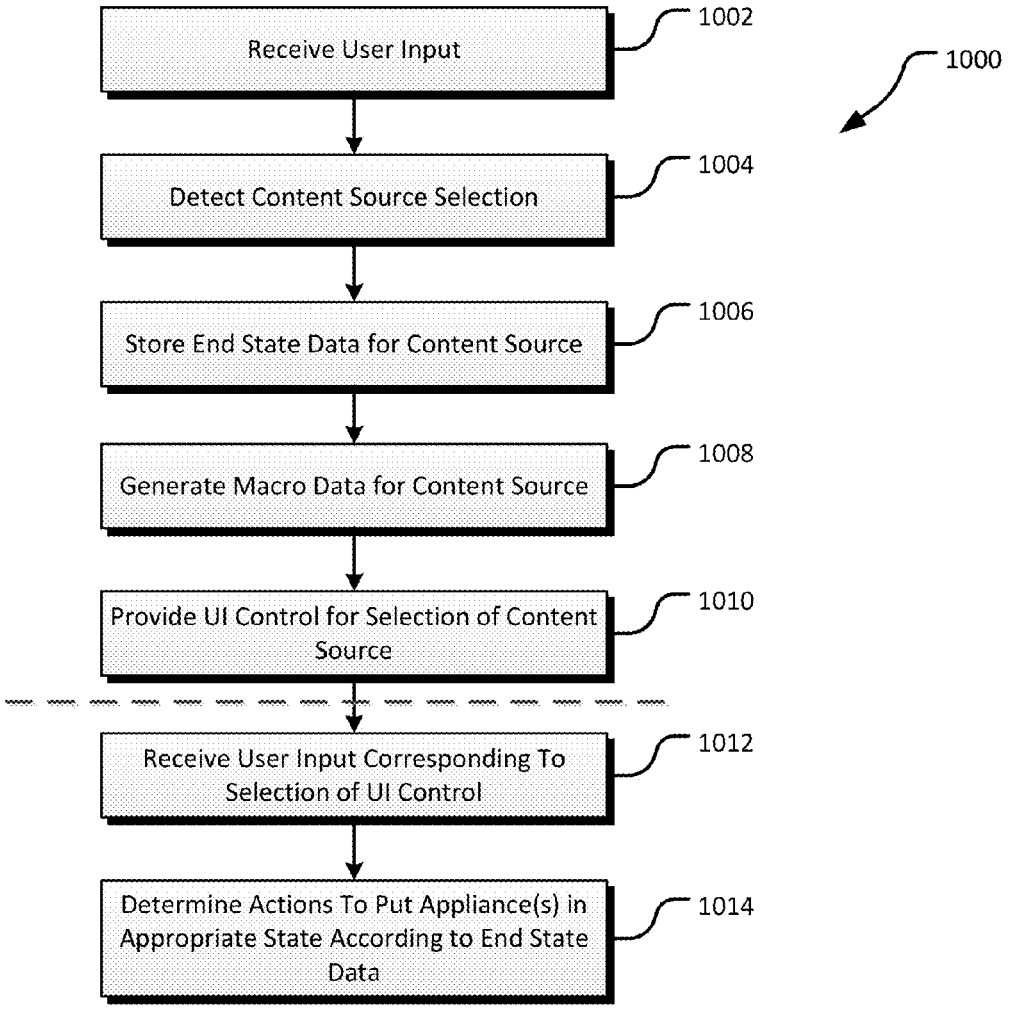
FIG. 10 shows an illustrative example of a process for dynamically configuring a remote control in accordance with at least one embodiment.

Various embodiments of the present disclosure also include techniques for intelligently updating a remote control according to how a user has used the remote control. FIG. 10 accordingly shows an illustrative example of a process 1000 for dynamically configuring a remote control based on how a user has used the remote control. In an embodiment, the process 1000 includes receiving 1002 user input such as described above. In some instances, receipt of the user input includes selection of a content source such as selection of content available from a video streaming service, music streaming service or a selection of a broadcast channel. The process 1000, in an embodiment, includes detecting 1004 a selection of content source. Detection of a content source may be performed in any suitable manner. Detection of the content source may be, for example, performed upon selection of a channel that is programmed into the remote control as a favorite channel or, generally, any identifier of a source of content, where the source of content may be such as described above. Detection of the content source may also include more sophisticated processing. For example, detection of a content source may occur upon recording, by a remote control or device working in connection with a remote control, a series of numerical inputs and/or channel up/channel down inputs (and/or signal transmissions) followed by a long pause of inactivity (where a long pause may be predefined to be a pause exceeding a specified length of time). In this example, detection may be made of a content source corresponding to a broadcast channel. As yet another example, detection of the content source may be made upon recording user input indicative of an application launch and selection of an "OK" button followed by a long pause of inactivity, the long pause indicating user selection of a content source due to the lack of activity (e.g., because content is being provided and, therefore, there is less need for remote control activity). Detection may also take into account a lack of only certain activity following some recorded event. For example, referring to the examples above regarding numerical input, upon recording the numerical input, inactivity with respect to further numerical input (and/or channel up/down input and/or other specified types of input) may cause detection of the content source selection.

Upon detection 1004 of content selection, in an embodiment, the process 1000 includes storing 1006 end state data for the content source. As noted above, a remote control or other device may track the state of various appliances. The state of the appliances may be recorded and, upon detection of the contents of the selection, the end state data may correspond to the current state data. Once end state data has been stored 1006, macro data may be generated 1008 for the content source. Macro data may be, for example, such as described above (e.g., a macro or template for a macro). A UI control for selection of the content source may then be provided 1010. For example, an icon representative of the content source may appear on the screen of a remote control. Providing the UI control may be dependent on further user input, such as input into the remote control by the user in response to a query to the user whether the UI control should be placed. Providing the UI control may also include placing the UI control in a portion of the GUI corresponding to recently accessed content sources. For instance, a location in the GUI, such as a dedicated screen, may be dedicated to recently accessed content sources and/or of recently accessed content sources of a certain type (e.g., broadcast TV channels). Similarly, a location in the GUI, such as a favorite channels list, a favorite contacts list, or generally some location designated for frequently accessed content may include one or more locations for content sources detected in connection with the process 1000 and/or variations thereof.

As indicated by the dashed line transversing FIG. 10, the process 1000 includes, possibly at a significantly later time, receiving user input corresponding to selection of the UI control corresponding to the detected content source. Accordingly, one or more actions to put one or more appliances in an appropriate state according to the end state data may be determined 1014. Determining the one or more actions may be performed in any suitable manner, such as described above. For example, current state data may be compared with end state data to determine which signals should be transmitted to put one or more appliances in an appropriate state.

Figure 11:
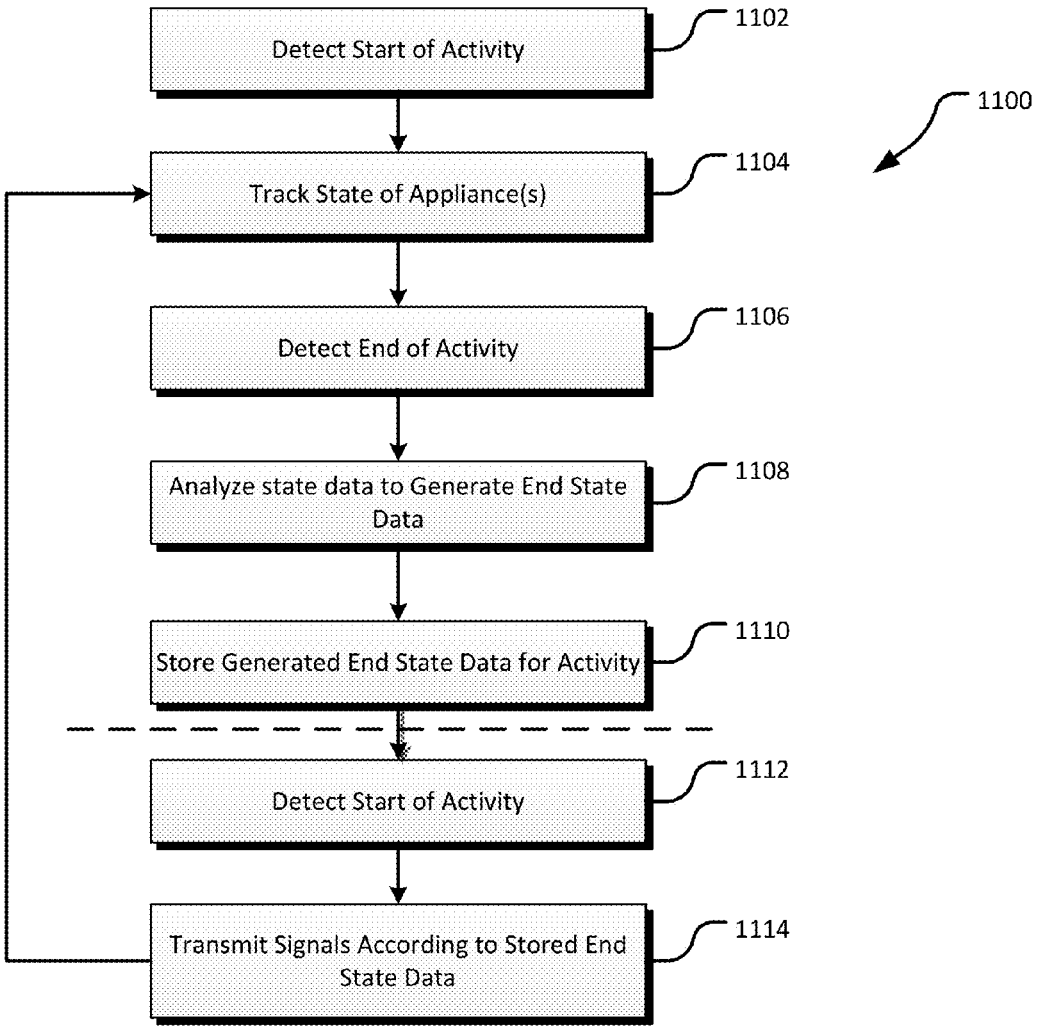
FIG. 11 shows another illustrative example of a process for dynamically configuring a remote control in accordance with at least one embodiment.

FIG. 11 shows another embodiment demonstrating techniques of the present disclosure for intelligently updating a remote control according to how a user has used the remote control. In particular, FIG. 11 shows an illustrative example of a process 1100 for dynamically adapting a remote control's configuration according to how a user controls one or more appliance during a particular activity. The process 1100 may be performed by any suitable device, such as a remote control or a device working in connection with a remote control. In an embodiment, the process 1100 includes detecting 1102 the start of an activity.

Detecting the start of the activity may be performed in any suitable manner. For example, detecting the start of the activity may be performed by detecting user input corresponding to selection of the activity. As another example, detecting the start of the activity may be performed by detecting selection of a content source, such as described above. Further, the activity may correspond to a pre-programmed macro or macro template (e.g., an activity specified by the user when configuring a remote control), although not necessarily. For example, in some embodiments users may program remote controls to have selectable activities, such as "Watch TV" or others, such that selection of an activity causes a macro to be executed which causes one or more appliances to update their state to a state appropriate for the activity. The macro may be pre-programmed or dynamically generated. As another example, activities may not be pre-programmed, but recognized by programming logic of the remote control. For example, a remote control may not be pre-programmed (e.g., by a user or manufacturer) with a selectable Watch TV activity, but the remote control may be programmed to detect (e.g., by analyzing button presses and/or transmissions from the remote control) when a user is watching television. Detecting the start of an activity may also be performed in other ways. For example, a user may provide explicit user input that specifies that an activity has started, such as by selecting a selectable GUI element that states "Start recording of settings for Activities."

In an embodiment, the state of one or more appliances involved in the activity is tracked 1104. While illustrated as a separate step following detection of the start of an activity, it should be noted that state tracking may occur at different times. For instance, state tracking may occur before the activity is detected. As noted above, state tracking may be accomplished in various ways. For example, as a user watches television, he or she may use a remote control to adjust the volume, switch to a particular surround or other sound mode, dim lights, change channels, view multiple channels simultaneously (e.g., using a picture-in-picture feature, and/or use the remote control to otherwise make other changes to the state of set of appliances participating in the activity. Such changes may be tracked by the remote control or another device, such as a device configured to monitor appliances and/or transmissions from the remote control. State may be tracked in various ways. In addition, state tracking may include processing recorded information for various reasons, such as reducing the amount of information recorded. As an example, an even number of presses of a mute button (which causes toggling between a zero volume state and a non-zero volume state) may be recorded to simply record which of two states a sound-producing appliance is in, instead of counting the number of presses. This may be done, for example, by counting mute button presses such that if a user completes an odd number of mute button presses, a value of 1 is stored, whereas if an even number of mute button presses is recorded, a value of 0 is stored. Other events in connection with buttons that cause sequential transitions between a finite number of states may be recorded similarly (e.g., counted modulo the number of possible states). Generally, recording of remote control events may be accomplished in any suitable manner.

In an embodiment, the process 1100 includes detecting the end of the activity. Detecting the end of the activity may be done in multiple ways in accordance with the various embodiments. For example, the end of event may be detected as a result of a remote control event corresponding to a power off command for one or more appliances. For instance, if the event is watching television, the power off event triggering detection of the end of the event may be a button selection causing a power off command to be sent to the television. Detecting the end of the activity may also be done in other ways, such as by explicit user input indicating that the event has ended or by detection that an appliance has been turned off by any means. Generally, detection of the end of the activity may be performed by satisfaction of one or more criteria for an event to end. In addition, the end of the activity, in some embodiments, need not correspond to the actual end of an activity (e.g., when a user powers off one or more appliances using the remote).

As an illustrative example, for the purpose of some embodiments of the process 1100, detecting the end of an activity may be accomplished by detecting the passage of a threshold amount of time of the activity's duration. More complicated criteria may also be used in connection with the detected end of activity not necessarily corresponding to the actual end of the activity. For example, television viewers often switch channels during commercial advertisements, but primarily watch a single program during a given duration of time. Accordingly, detecting the end of the activity may include detection of exceeding a threshold amount of time engaged (e.g., tuned) with a content source, where the amount of time is aggregated over some time period. An additional condition may include that the percentage of time spent with a particular content source exceed some threshold. In this manner, short secondary interactions with other content sources may be taken into account. Generally, the process 1100 may be adapted to detect satisfaction of any conditions for when to proceed with the process.

Upon detection of the end of the activity, the process 1100 may include analyzing 1106 recorded state data maintained while tracking state to generate end state data for the activity. Analyzing the recorded state data may include determining the state of one or more appliances at a particular time, such as a time immediately before detection of the end of the activity. It should be noted that state data may be maintained during state tracking in a manner allowing for determining the state just prior to the detected end of the activity. For example, in some embodiments, the state data includes data for two states: the current state of one or more appliances and the state of the one or more appliances just before the last remote control event (or the last N remote control events, N being a positive integer). The state just before detection of the end of the activity may also be determined by analyzing current state data and, based at least in part on last user input event (or command transmission) that triggered detection of the end of the event, determining what the state prior to the triggering event was. For instance, if detecting the end of the activity includes detecting user input corresponding to a power off command, it can be determined that, prior to causing the power of the corresponding appliance to be off, its power was on. Volume settings, channel settings, and other settings that may be reset (while maintaining state data) upon detection of the power off user input may be stored in memory so as to not be lost upon reset. The generated end state data may be stored 1110 in memory of the remote control or another device.

At a subsequent time, start of the activity may be detected 1112, such as in a manner described above, which may be a different manner than detected earlier in the process 1100. Upon detection 1112 of the start of the activity, the end state data may be used to transmit one or more signals according to the end state data. For example, the end state data may be used to transmit signals that cause volume settings, surround sound settings, input settings, and other settings to be as they were when the end of the activity was detected. As illustrated in FIG. 11, the state of the relevant appliances for the activity may be tracked and portions of the process 1100 may repeat so that the remote control is able to dynamically adjust its settings as user preferences may adjust over time.

While not illustrated as such, additional steps may also be included in performance of the process 1100 and variations thereof. For example, before updating and storing new end state data, the user may be prompted for a decision whether to do the updating and whether the update is made may depend on the user's response. In addition, other variations are also within the scope of the present disclosure. For example, various conditions may be used to determine whether to update remote control settings. For instance, the number of times a user starts an activity and subsequently provides user input for a particular setting (e.g., setting a television to a particular aspect ratio) may be counted and, if the count exceeds a threshold, end state data (and/or macro data) for the activity may be updated. In addition or as an alternative, an update may further depend on a ratio of starts of the activity followed by setting the change to starts of the activity without a subsequent setting change. For example, calculating that the user more often than not (or more often than some percentage) subsequently changed the television aspect ratio after starting a watch TV activity, and that the activity has been started at least some threshold of time, end state data for a watch TV activity may only then be updated to reflect the aspect ratio.

As noted, numerous variations are within the scope of the present disclosure. For example, numerous examples are given regarding remote controls in the traditional sense of the phrase, that is, devices that both accept user input and transmit signals to devices to control the devices. The techniques described and suggested herein are generally applicable to remote control systems, that is, collections of one or more devices that collectively operate to control sets of one or more appliances. As one example, embodiments of the present disclosure apply to remote control systems where a first device transmits signals to a second device that reactively transmits signals to the appliances, possibly using a different communications protocol, thereby acting as an intermediary between the first device and the appliance(s). The first device could be configured to have a primary purpose of transmitting such signals to the second device. As another example, the first device could be a smartphone and/or tablet computing device and/or other device with a remote control application. The first device, in this example, may transmit signals to the second device over a network, such as a local network within a home or other locale. In addition, a remote control system may include even more devices, each playing a role in the control of one or more appliances. Further, operations described above (e.g., analysis, state tracking, and other operations) may be performed by various devices in various remote control systems. For example, state tracking may be performed by a device different from a handheld controller, such as a device that monitors and/or is controlled by signals transmitted by the handheld controller.

Further, the description above discusses various interface features, such as buttons, icons, gestures, and the like. Different types of input may be combined in a way that provides numerous advantages. For example, a small circle gesture could be done over an icon displayed on a touchscreen. The remote control may interpret this as "tune to this channel at the top of the hour" and may configure a macro to execute an the appropriate time. Such input techniques would be useful in a variety of circumstances. For example, if a user was watching Seinfeld right now, but knew that he/she wanted to switch to CBS at 4:00 to watch Friends, such user input is a simple way to instruct the remote control to execute an appropriate macro (which may be a simple macro comprising a sequence of channel number commands). Thus, a simple gesture on an icon can set this up—which is much less complicated than having to do so through a series of menus. Gestures, therefore, provide a lot of flexibility, especially when combined with other interface elements. As another example, a gesture could cause transmission of a record signal to a user's DVR at the appointed time. In this example, for instance, if the user is watching a football game that might run over, you can automatically start recording another show at 5 o'clock on NBC. Thus, advanced functionality is achieved using a remote control without having to interrupt your TV viewing (no need to bring up channel menu on TV screen, e.g.).

Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions and equivalents falling within the spirit and scope of the invention, as defined in the appended claims.

The use of the terms "a" and "an" and "the" and similar referents in the context of describing the disclosed embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this disclosure are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications and patents, cited herein are hereby incorporated by reference to the same extent as if each reference were individually and specifically indicated to be incorporated by reference and were set forth in its entirety herein.

What is claimed is:

1. A method for updating a control device configured to control a plurality of appliances in a coordinated manner for different activities, comprising:

detecting a first starting of a first activity of the different activities;

tracking the state of one or more appliances involved in the first activity;

detecting a first ending of the first activity;

analyzing state data for the one or more appliances obtained at least partially between the first starting and the first ending;

at least one of generating, or updating, an end-state data associated with the first activity for the one or more appliances based on the analysis of the state data;

detecting a second starting of the first activity;

accessing the end-state data associated with the first activity; and modifying a state of the one or more appliances based on the second starting of the first activity and the end-state data.

2. The method of claim 1, wherein the end state data includes an indication that a computer application should be running, and modifying the state of the one or more appliances based on the end-state data includes sending a signal from the control device to the one or more appliances to change the state of the one or more appliances to a state corresponding to the end-state data by opening the computer application.

3. The method of claim 1, wherein the activity corresponds to a pre-programmed macro including instructions for a plurality of appliances.

4. The method of claim 1, wherein detecting the start of the first activity includes detecting a user input corresponding to selection of the first activity.

5. The method of claim 1, wherein detecting the start of the first activity includes detecting selection of a content source, and the control device determines the first activity from among the different activities based on the selected content source.

6. The method of claim 1, further comprising receiving a user command to start the first activity, wherein receiving the user command to start the first activity causes a macro to be executed that causes the one or more appliances to update their state to a state corresponding to the end-state data.

7. The method of claim 1, wherein at least one of said detecting of the first starting and said detecting of the first ending is based on commands entered to the control device.

8. The method of claim 1, wherein tracking the state of the one or more appliances involved in the first activity is based on at least a use of the control device.

9. The method of claim 1, wherein detecting the first ending of the first activity is based on a power off command that is input to the control device, and the end-state data is based on a state of the one or more appliances prior to the control device sending the power off command.

10. The method of claim 1, further comprising querying a user of the control device whether to update the end-state data based at least in part on detecting the first ending of the first activity.

11. The method of claim 10, wherein the querying of the user on whether to update the end-state data is presented based on the control device detecting the first ending of the first activity.

12. The method of claim 1, wherein detecting the end of the activity is based on a predetermined period of time associated with the first activity.

13. The method of claim 1, further comprising:

detecting a second ending of the first activity;

analyzing state data for the one or more appliances obtained at least partially between the second starting and the second ending;

updating the end-state data for the one or more appliances based on the analysis of the state data obtained at least partially between the second starting and the second ending;

detecting a third starting of the first activity; and modifying the state of the one or more appliances based on the third starting of the first activity and the updated end-state data.

14. The method of claim 1, further comprising generating a macro based on at least three of the first activity, a selected media content source corresponding to the first activity, the end-state data, and current state data of the one or more appliances.

15. The method of claim 1, further comprising obtaining a device inventory for a user of the control device, obtaining a user interface design parameter for the user, and generating a user interface for the control device based on the device inventory and the design parameter.

16. The method of claim 1, further comprising:

receiving a user selection indicating a content source;

obtaining macro data based on the content source; and generating a macro based on the obtained macro data.

17. A controller, comprising:

a user interface;

a wireless communication device;

a processor; and a memory including computer-executable instructions that, when executed, configure the processor to:

detect a first starting of an activity;

track the state of one or more appliances involved in the activity;

detect a first ending of the activity;

analyze state data for the one or more appliances obtained at least partially between the first starting and the first ending;

at least one of generate, or update, an end-state data associated with the activity for the one or more appliances based on the analysis of the state data;

detect a second starting of the activity;

access the end-state data associated with the activity;

access current-state data for the one or more appliances involved in the activity; and generate a macro, executable by the controller, and configured to modify a state of the one or more appliances based on the second starting of the activity, the current-state data, and the end-state data.

18. The controller of claim 17, wherein modifying the state of the one or more appliances based on the end-state data includes sending a signal from the controller to the one or more appliances to change the state of the one or more appliances to a state corresponding to the end-state data.

19. The controller of claim 17, wherein detecting the start of an activity includes detecting a user input to the user interface corresponding to selection of the activity.

20. The controller of claim 17, wherein tracking the state of the one or more appliances involved in the activity is based on a use of the controller.

21. The controller of claim 17, wherein detecting the first ending of the activity is based on a power off command that is input to the controller, and the end-state data is based on a state of the one or more appliances prior to the controller sending the power off command.

22. The controller of claim 17, further comprising instructions for:

detecting a second ending of the activity;

analyzing state data for the one or more appliances obtained at least partially between the second starting and the second ending;

updating the end-state data for the one or more appliances based on the analysis of the state data obtained at least partially between the second starting and the second ending;

detecting a third starting of the activity; and modifying the state of the one or more appliances based on the third starting of the activity and the updated end-state data.

23. A non-transitory computer-readable storage medium including computer-executable instructions for configuring one or more processors to perform a method comprising:

receiving a command on a control device to start an activity involving one or more appliances;

detecting a first starting of the activity;

tracking the state of one or more appliances involved in the activity;

detecting a first ending of the activity;

analyzing state data for the one or more appliances obtained at least partially between the first starting and the first ending;

at least one of generating, or updating, an end-state data associated with the activity for the one or more appliances based on the analysis of the state data;

detecting a second starting of the activity;

accessing the end-state data associated with the activity; and modifying a state of the one or more appliances based on the second starting of the activity and the end-state data.

24. The non-transitory computer-readable storage medium of claim 23, wherein the activity corresponds to a pre-programmed macro including instructions for a plurality of appliances.

25. The non-transitory computer-readable storage medium of claim 23, wherein detecting the start of the activity includes detecting selection of a content source.

26. The non-transitory computer-readable storage medium of claim 23, further comprising instructions for generating a macro based on at least two of the activity, a selected media content source corresponding to the activity, the end-state data, and current state data of the one or more appliances.

27. The non-transitory computer-readable storage medium of claim 23, further comprising instructions for obtaining a device inventory for a user of the control device, obtaining a user interface design parameter for the user, and generating a user interface for the control device based on the device inventory and the design parameter.

28. The non-transitory computer-readable storage medium of claim 23, further comprising instructions for:

receiving a user selection indicating a content source;
obtaining macro data based on the content source; and
generating a macro based on the obtained macro data.

* * * * *